US011291267B2

(12) United States Patent
James

(10) Patent No.: US 11,291,267 B2
(45) Date of Patent: Apr. 5, 2022

(54) SHOE CONSTRUCTION

(71) Applicant: Laurence James, Greenwich, CT (US)

(72) Inventor: Laurence James, Greenwich, CT (US)

( * ) Notice: Subject to any disclaimer, the term of this patent is extended or adjusted under 35 U.S.C. 154(b) by 157 days.

(21) Appl. No.: 16/361,483

(22) Filed: Mar. 22, 2019

(65) Prior Publication Data

US 2020/0054092 A1 Feb. 20, 2020

Related U.S. Application Data

(63) Continuation of application No. 14/213,196, filed on Mar. 14, 2014, now Pat. No. 10,238,168.
(Continued)

(51) Int. Cl.

| | |
|---|---|
| ***A43B 7/14*** | (2006.01) |
| ***A43B 7/22*** | (2006.01) |
| ***A43B 7/142*** | (2022.01) |
| ***A43B 7/143*** | (2022.01) |
| ***A43C 5/00*** | (2006.01) |
| ***A43C 11/00*** | (2006.01) |
| ***A43C 11/08*** | (2006.01) |

(52) U.S. Cl.
CPC ..... *A43B 7/142* (2013.01); *A43B 7/143* (2013.01); *A43B 7/22* (2013.01); *A43C 5/00* (2013.01); *A43C 11/00* (2013.01); *A43C 11/08* (2013.01)

(58) Field of Classification Search
CPC ..... A43B 7/142; A43B 7/143; A43B 7/144; A43B 7/1415; A43B 7/1445; A43B 7/22; A43B 7/24; A43B 7/1405; A43B 5/06; A43B 13/41; A43B 13/12; A43B 13/125; A43B 13/128; A43B 13/42; A43B 23/16; A43B 23/17; A43B 23/22; A43B 23/222; A43B 23/227; A43B 23/08; A43B 23/088; A43B 13/10; A43C 11/00; A43C 11/006; A43C 11/008; A43C 11/08; A43C 11/12; A43C 5/00; A43C 11/22; A43C 11/16; A43C 3/00; A43C 3/02; A43C 3/04
USPC .... 36/91, 92, 145, 50.1, 51, 142, 144, 25 R, 36/30 R, 31, 28, 148, 149, 68, 69, 76 R, 36/76 H
See application file for complete search history.

(56) References Cited

U.S. PATENT DOCUMENTS 2,689,991 A * 9/1954 Fedankiw ..... A43C 11/22 36/50.1
3,683,460 A * 8/1972 Baso ..... A43C 11/142 24/70 SK
(Continued)

*Primary Examiner* — Heather Mangine

(57) ABSTRACT

An improved article of footwear of the invention includes an upper, an adjustable closure system affixed to the upper, the closure system having a guide member having a first groove portion and a second groove portion, a fastening member positioned opposite the guide member and having at least two tensioning members, and removable cable assembly connecting the guide member and the fastening member, wherein the cable assembly extends sequentially through the first groove portion of the guide member, a first tensioning member of the fastening member, the second groove portion of the guide member, and a second tensioning member of the fastening member, a bottom secured to the upper, a stabilizing member positioned between the upper and the bottom, wherein the stabilizing member has a base portion and at least one of a lateral support portion and a medial support portion extending upwardly from opposing sides of the base portion.

5 Claims, 27 Drawing Sheets

Related U.S. Application Data

(60) Provisional application No. 61/789,943, filed on Mar. 15, 2013.

(56) References Cited

U.S. PATENT DOCUMENTS 3,731,350 A * 5/1973 Diebold ..... A43C 11/00 24/712
3,834,048 A * 9/1974 Maurer ..... A43C 11/16 36/50.1
4,095,354 A * 6/1978 Annovi ..... A43B 5/04 24/598.4
4,484,397 A * 11/1984 Curley, Jr. ..... A43B 23/17 36/132
4,648,159 A * 3/1987 Dougherty ..... A41F 1/04 24/129 R
4,823,484 A * 4/1989 Gouty ..... A43C 11/008 24/68 SK
4,947,560 A * 8/1990 Fuerst ..... A43B 5/00 36/114
4,970,763 A * 11/1990 Nwoko ..... A43C 3/00 24/714.4
5,060,401 A * 10/1991 Whatley ..... A43B 13/18 36/25 R
5,117,567 A * 6/1992 Berger ..... A43B 1/0072 36/50.1
5,152,084 A * 10/1992 Bonnaventure ..... A43B 5/0433 36/105
5,177,882 A * 1/1993 Berger ..... A43B 1/0072 36/50.1
5,218,773 A * 6/1993 Beekman ..... A43B 5/00 36/30 R
5,293,669 A * 3/1994 Sampson ..... A43C 11/14 24/16 PB
5,325,613 A * 7/1994 Sussmann ..... A43C 11/00 24/712.2
5,327,662 A * 7/1994 Hallenbeck ..... A43C 11/00 36/50.1
5,537,763 A * 7/1996 Donnadieu ..... A43C 1/00 36/50.1
5,651,197 A * 7/1997 James ..... A43B 7/1495 36/50.1
5,791,021 A * 8/1998 James ..... A43C 1/003 24/68 SK
5,848,457 A * 12/1998 Silagy ..... A43C 1/02 24/712.1
6,018,891 A * 2/2000 Duclos ..... A43B 3/14 36/102
6,073,319 A * 6/2000 Silagy ..... A43C 1/02 24/712.1
6,502,329 B1 * 1/2003 Silagy ..... A43C 3/00 24/713.4
6,922,917 B2 * 8/2005 Kerns ..... A43B 5/14 36/50.1
7,464,489 B2 * 12/2008 Ho ..... A43B 13/181 36/28
7,617,573 B2 * 11/2009 Chen ..... A43C 1/00 24/68 SK
7,946,061 B2 * 5/2011 Holzer ..... A43C 11/14 36/50.5
8,196,316 B2 * 6/2012 Cook ..... A43B 13/141 36/30 R
8,434,244 B2 * 5/2013 Litchfield ..... A43B 13/203 36/29
8,468,657 B2 * 6/2013 Soderberg ..... A43C 11/165 24/68 SK
9,375,052 B2 * 6/2016 Krueger ..... A43C 11/165
9,795,187 B2 * 10/2017 Cavaliere ..... A43B 3/26
9,901,136 B2 * 2/2018 Fujita ..... A43B 21/26
2002/0017036 A1 * 2/2002 Berger ..... A43B 13/186 36/3 B
2002/0095750 A1 * 7/2002 Hammerslag ..... A43C 11/16 24/68 SK
2003/0019127 A1 * 1/2003 Parisotto ..... A43B 13/223 36/25 R
2003/0192202 A1 * 10/2003 Schoenborn ..... A43B 7/142 36/30 R
2004/0181972 A1 * 9/2004 Csorba ..... A43C 11/14 36/50.1
2005/0102861 A1 * 5/2005 Martin ..... A43C 1/003 36/50.5
2006/0000116 A1 * 1/2006 Brewer ..... A43B 5/00 36/50.1
2006/0042120 A1 * 3/2006 Sokolowski ..... A43B 13/187 36/29
2006/0179685 A1 * 8/2006 Borel ..... A43C 7/00 36/50.1
2006/0191163 A1 * 8/2006 Nakano ..... A43B 13/12 36/30 R
2007/0011914 A1 * 1/2007 Keen ..... A43C 11/00 36/50.1
2007/0101617 A1 * 5/2007 Brewer ..... A43B 7/144 36/103
2007/0107264 A1 * 5/2007 Meschter ..... A43B 23/227 36/76 R
2007/0220778 A1 * 9/2007 Fusco ..... A43B 13/125 36/30 R
2007/0240334 A1 * 10/2007 Johnson ..... A43C 7/04 36/50.1
2008/0016724 A1 * 1/2008 Hlavac ..... A43B 13/12 36/30 R
2008/0250673 A1 * 10/2008 Andrews ..... A43B 13/186 36/25 R
2008/0282579 A1 * 11/2008 Bobbett ..... A43B 13/026 36/127
2009/0100707 A1 * 4/2009 Bar ..... A43C 1/00 36/50.1
2009/0260259 A1 * 10/2009 Berend ..... A43B 7/24 36/88
2009/0320330 A1 * 12/2009 Borel ..... A43B 13/14 36/30 R
2010/0251565 A1 * 10/2010 Litchfield ..... A43B 13/181 36/28
2010/0287792 A1 * 11/2010 Hide ..... A43B 5/10 36/114
2010/0307025 A1 * 12/2010 Truelsen ..... A43B 7/24 36/28
2011/0088283 A1 * 4/2011 Berth ..... A43B 5/0411 36/50.1
2012/0131819 A1 * 5/2012 Loverin ..... A43B 21/06 36/35 R
2012/0159814 A1 * 6/2012 Smith ..... A43B 13/12 36/92
2012/0174433 A1 * 7/2012 Mahoney ..... A43B 23/0235 36/28
2013/0125421 A1 * 5/2013 Stegmaier ..... A43B 13/141 36/102
2013/0152425 A1 * 6/2013 Borel ..... A43C 11/00 36/83
2013/0205620 A1 * 8/2013 Hsu ..... A43B 7/148 36/91
2013/0232814 A1 * 9/2013 Blum ..... A43B 7/1465 36/43
2014/0068838 A1 * 3/2014 Beers ..... A41D 27/08 2/243.1
2014/0305005 A1 * 10/2014 Yeh ..... A43B 7/143 36/69
2015/0040425 A1 * 2/2015 Adams ..... A43B 13/026 36/29
2015/0143720 A1 * 5/2015 Avar ..... A43B 23/16 36/107
2015/0327622 A1 * 11/2015 Chaigne ..... A43B 5/002 36/114
2015/0351490 A1 * 12/2015 Lam ..... A43B 13/42 36/108
2016/0015122 A1 * 1/2016 Nishiwaki ..... A43B 13/187 36/30 R

(56) References Cited

U.S. PATENT DOCUMENTS

| | | | | |
|---|---|---|---|---|
| 2016/0157554 | A1* | 6/2016 | Adams | A43B 13/189 36/28 |
| 2016/0183631 | A1* | 6/2016 | Scofield | A43B 13/189 36/28 |
| 2017/0258179 | A1* | 9/2017 | Conant | A43B 13/188 |

* cited by examiner

SHOE CONSTRUCTION

FIELD OF THE INVENTION

This invention relates to an article of footwear. More specifically, the invention relates to a construction for an article of footwear designed to address stability control with a closure system used in combination with a midsole, outsole, and a variety of medial and lateral shank portions that provide flexibility or stability where pressure across a wearer's foot is more or less desirable.

BACKGROUND OF THE INVENTION

Athletic shoes typically include a bottom portion for providing traction and cushioning, and an upper for holding the foot of the wearer to the bottom portion. An athletic shoe may include a standard lace closure and a shank for added upper support. Bottoms are usually comprised of an outsole and a midsole. The outsole is typically constructed from a durable material like rubber that resists wear and provides traction with a contact surface. The midsole, located between the upper and the outsole, comprises a middle layer of an athletic shoe and is typically constructed from a soft foam material such as EVA (ethylene vinyl acetate) to lessen the impact forces caused during athletic activity. The foam midsole may include other cushioning elements, such as an air bladder and a shank to provide added stiffness and stability. An insole layer is usually a thin padded member made from EVA or PU (polyurethane) that is inserted into and rests at the base of the upper for added cushioned comfort.

In general, athletic shoes are designed with symmetrical medial and lateral sides of support. However, such designs do not take into account each athlete's individual physiology. For example, gait assessments classify an athlete's footstrike into three categories: neutral, underpronation and overpronation. A neutral footstrike is considered normal, whereas underpronators (supinators) tend to footstrike on a lateral (outside) portion of their shoes, and overpronators tend to roll their footstrike on the medial (inside) portion of their shoes, thereby creating instability and inefficiency that may lead to early fatigue and injury. Even athletes with neutral footstrikes require stability considerations. Accordingly, an article of footwear must meet a variety of gait characteristics to meet performance goals and minimize injury. U.S. Pat. No. 6,108,943 discloses lateral stability along the entire length of an upper which may be undesirable for an athlete who overpronates.

U.S. Pat. No. 8,074,379 is a recent attempt to fasten a shoe around a wearer's foot with a cable system and shank but it repeats the same failures that conventional lace and eyelet systems have caused for many years. Binding, release, and mechanical failures continue to plague mechanical type reel systems, especially when grit and grime are introduced into a myriad of multiple layers of small toothed gears. Such reel based closure systems also incorporate a shank, but are only capable of applying equal tension across the entire arch and instep.

U.S. Pat. No. 5,647,104 discloses a cable closure system comprising two cinching members, three spaced apart guide members and an anchoring member. However, numerous spaced apart guides on a shoe upper do not allow for strategic multiple closure systems due to the limited area in which to locate them. A further limitation in the '104 patent involves an increased amount of varying cable lengths due to adjustment limitations across a smaller anchoring area and the inability to adjust the cable length across fixed guide members.

Additionally, U.S. Pat. No. 5,319,866 discloses a split midsole design with a cookie arch support for pronators. However, such a design would be unsuitable for a neutral footstrike or underpronator. Furthermore, midsoles, outsoles, and uppers in this asymmetrical configuration do not work in concert to provide a more stable article of footwear. Instead, without the midsole support, an athlete is more likely to overpronate, thereby defeating the purpose of adding a cookie arch support between the midsole and the upper.

Orthotic inserts, otherwise known as "orthotics," are stability enhancers that may include cushioning properties and rigid material. Orthotics are typically inserted into and rest at the base of the upper in direct contact with the wearer's feet. Orthotics come in a variety of densities. Soft orthotics are typically made from a foam material in attempt to match the contour of a respective foot. Although a soft orthotic attempts to provide a cushioning effect, it provides minimal stability support. Cushioning is desirable in most athletic shoes, but the primary benefit of an orthotic insert is its ability to control and stabilize the motions of a footstrike as it completes the gait cycle. From foot flex to absorb heel impact loads, to a more rigid toe-off phase, the primary goal of the orthotic device is to maintain proper control of the impact forces involved. Soft orthotics barely exert enough control over the gait cycle to meet the high demands of an otherwise rigid requirement. Over the course of their development, soft orthotics have evolved to include stiffeners that provide more support than a foam based material. For example, some soft orthotics include a rigid thermoplastic structure in strategic areas, but such systems are still compromised due to the soft compressible foam material associated with soft orthotics.

Rigid orthotic inserts described in U.S. Pat. No. 6,976,322, are thinner than soft orthotic inserts, and offer increased control and stability. However, rigid orthotics are often too stiff against the foot when placed in an upper, causing undesirable discomfort and occupying valuable interior footbed space in an otherwise minimally constructed upper with superior strength to weight characteristics. Most athletes find custom orthotics made by prescription cost prohibitive, and the benefits they seek may be achieved by using a standardized orthotic in conjunction with a more intelligently constructed article of footwear.

Accordingly, there exists a need for an orthotic insert in the form of a shank having sufficient rigidity to properly control the motions of the foot that can be manufactured efficiently and at low cost. Furthermore, in view of the above shortcomings, there exists a need for an orthotic that has sufficient resilient flexibility so that it is able to provide stability to the foot and shoe as the foot progresses through the gait cycle. Still further, there exists a need for a thin soft insole layer since existing orthotic inserts are typically rigid, semi-rigid, or constructed from a combination of soft foam and rigid materials that may cause crowding and raise the foot out of the heel pocket creating discomfort or deterring optimum athletic performance. Additionally, there exists a need for an orthotic that does not encumber the interior of an upper yet controls lateral and medial portions of the upper in combination with a closure system that can apply independent tensioning means across an arch and instep with a bottom that provides added stability according to an athlete's individual physiology. And finally, there is a need for a closure system that provides a fastening cable with more effective length options to achieve a more customized fit of the shoe.

SUMMARY OF THE INVENTION

In order to overcome the shortcomings and disadvantages of the prior art shoe constructions and to achieve at least the above-mentioned objectives, an article of footwear is provided including an upper, an adjustable closure system affixed to the upper, the closure system having a guide member with a first groove portion and a second groove portion, a fastening member positioned opposite the guide member and having at least two tensioning members, and a cable assembly connecting the guide member and the fastening member, wherein the cable assembly extends sequentially through the first groove portion of the guide member, a first tensioning member of the fastening member, the second groove portion of the guide member, and a second tensioning member of the fastening member, a bottom secured to the upper, a stabilizing member positioned between said upper and said bottom, wherein said stabilizing member comprises a base portion and at least one of a lateral support portion and a medial support portion extending upwardly from opposing sides of the base portion.

In some embodiments, the upper includes a first side panel and a second side panel, the guide member is affixed to the first side panel and the fastening member is affixed to the second side panel. In certain of these embodiments, the first side panel and the second side panel have different stiffness such as to provide different degree of support to a wearer's foot.

In certain embodiments, the bottom has a heel portion, a forepart portion, and an arch portion positioned between the heel portion and the forepart portion, and the lateral and medial support portions of the stabilizing member are positioned in the arch portion of the bottom.

In some cases, at least one of the base portion, the lateral support portion and the medial support portion of the stabilizing member is adapted to compress and relax as pressure is exerted on the article of footwear by a wearer's foot.

In certain embodiments, the stabilizing member includes the base portion, the lateral support portion and the medial support portion.

In some embodiments, the closure system further includes a gripping member secured to the cable assembly, wherein the gripping member facilitates adjustment of the closure system by a user.

In certain embodiments, the closure system further includes a plurality of interchangeable cable assemblies having different lengths.

In some embodiments, the cable assembly is a removable closed-loop cable.

In certain embodiments, the cable assembly is snap-fit into the guide member and the fastening member.

In some cases, the cable assembly is slidable through at least one of the guide member and the fastening member.

In certain embodiments, the cable assembly has a first end, a second end and a cable portion, wherein the first and second ends are secured to the fastening member and the cable portion extends through the first groove portion of the guide member, one of the at least two tensioning members of the fastening member, and the second groove portion of the guide member.

In some cases, the article of footwear includes two or more closure systems affixed to the upper.

In certain embodiments, the fastening member has a first tensioning member, a second tensioning member, and a third tensioning member, and a first loop of the cable assembly extends through one of the first, second and third tensioning members, and a second loop of the cable assembly extends through one of the first, second and third tensioning members.

An adjustable closure system is also provided, including a guide member having a first groove portion and a second groove portion, a fastening member positioned opposite the guide member and having at least two tensioning members, and a cable assembly connecting said guide member and said fastening member, wherein the cable assembly extends sequentially through the first groove portion of said guide member, a first tensioning member of said fastening member, the second groove portion of said guide member, and a second tensioning member of said fastening member.

In some embodiments, the closure system further includes a gripping member secured to the cable assembly, wherein the gripping member facilitates adjustment of the closure system by a user.

In certain embodiments, the closure system includes a plurality of interchangeable cable assemblies having different lengths.

In some cases, the cable assembly is a closed-loop cable.

In certain embodiments, the cable assembly has a first end, a second end and a cable portion, wherein the first and second ends are secured to the fastening member and the cable portion extends through the first groove portion of the guide member, one of the at least two tensioning members of the fastening member, and the second groove portion of the guide member.

In some embodiments, the cable assembly is snap-fit into the guide member and the fastening member.

In certain embodiments, the cable assembly is slidable through at least one of the guide member and the fastening member.

An article of footwear, including an upper, a bottom secured to the upper and having an arch portion, and a stabilizing member positioned between the upper and the bottom, wherein the stabilizing member includes a base portion, and at least one of a lateral support portion and a medial support portion, wherein the lateral and medial support portions are positioned in the arch portion of the bottom and extend upwardly from opposing sides of the base portion.

In some embodiments, the stabilizing member includes the base portion, the lateral support portion and the medial support portion. In additional embodiments, the stabilizing member includes the base portion and the lateral support portion. In further embodiments, the stabilizing member includes the base portion and the medial support portion.

In certain embodiments, the base portion is adapted to compress and relax as pressure is exerted thereon by a wearer's foot.

In some cases, at least one of the lateral support portion and the medial support portion is adapted to compress and relax as pressure is exerted on said stabilizing member by a wearer's foot.

In certain embodiments, the stabilizing member further comprises a rear support member positioned in a heel area of said bottom and extending upwardly from the base portion.

In some embodiments, the lateral support portion and the medial support portion of said stabilizing member have a reinforced perimeter.

In certain embodiments, the bottom further includes at least one of a lateral support member and a medial support member positioned in the arch portion of the bottom, and the lateral and medial support members of the bottom interact with the lateral and medial support portions of the stabilizing member to provide support for a wearer's foot.

Other objects of the invention and its particular features and advantages will become more apparent from consideration of the following drawings and accompanying detailed description.

DETAILED DESCRIPTION OF THE INVENTION

Figure 1:
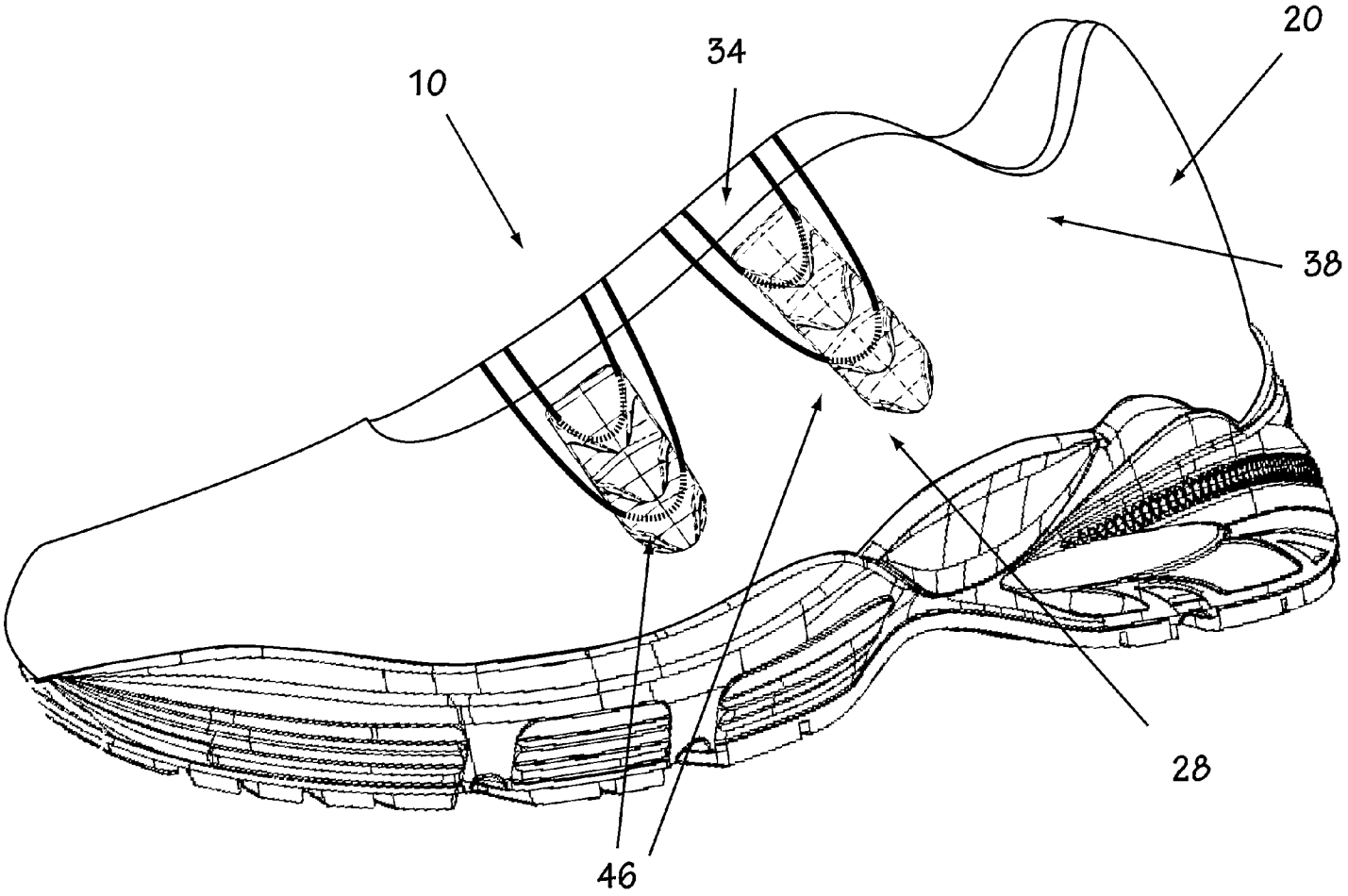
FIG. 1 is a perspective view of the article of footwear in accordance with the present invention.
Figure 2:
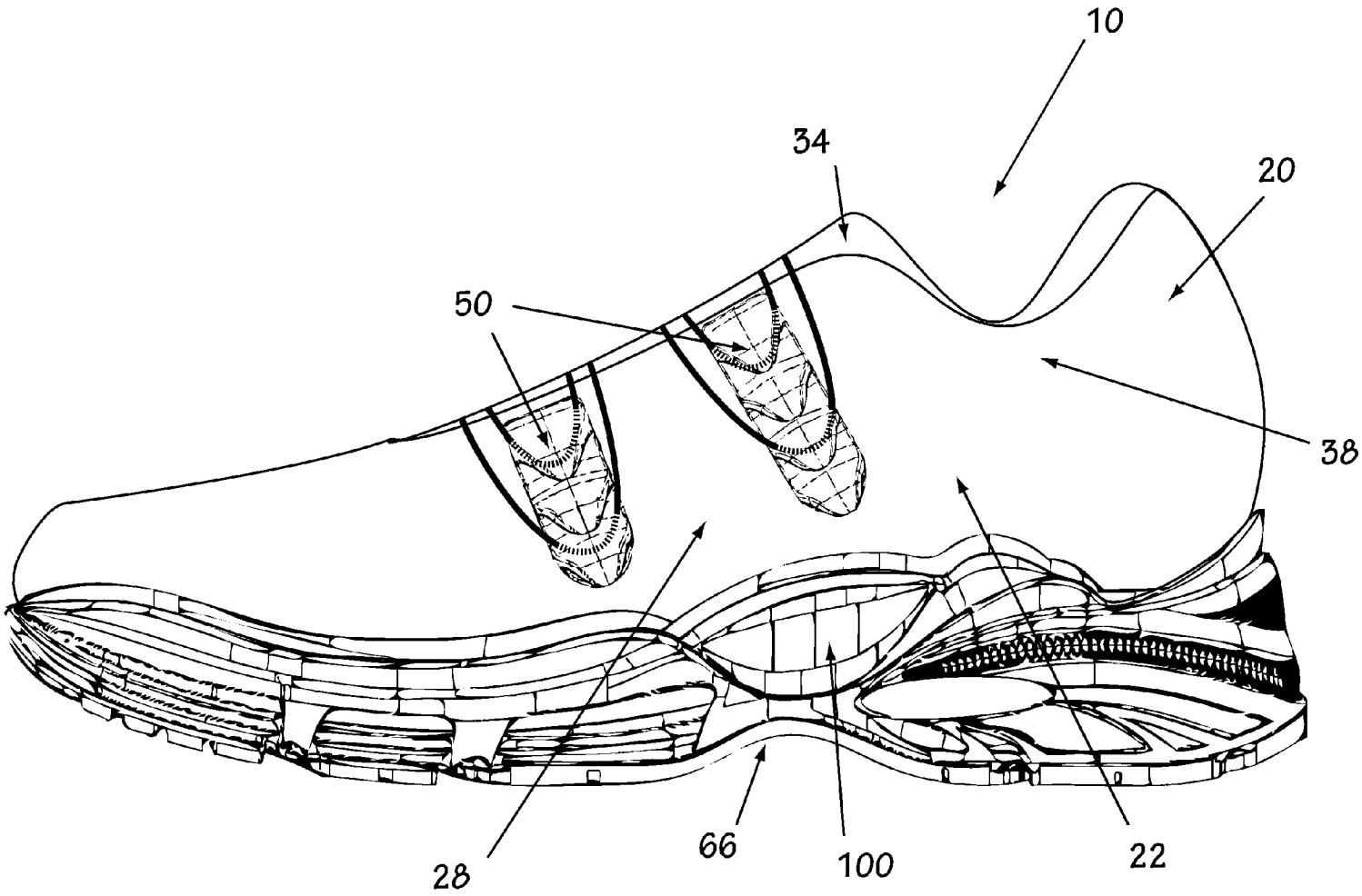
FIG. 2 is a lateral side view of the article of footwear of FIG. 1.
Figure 3:
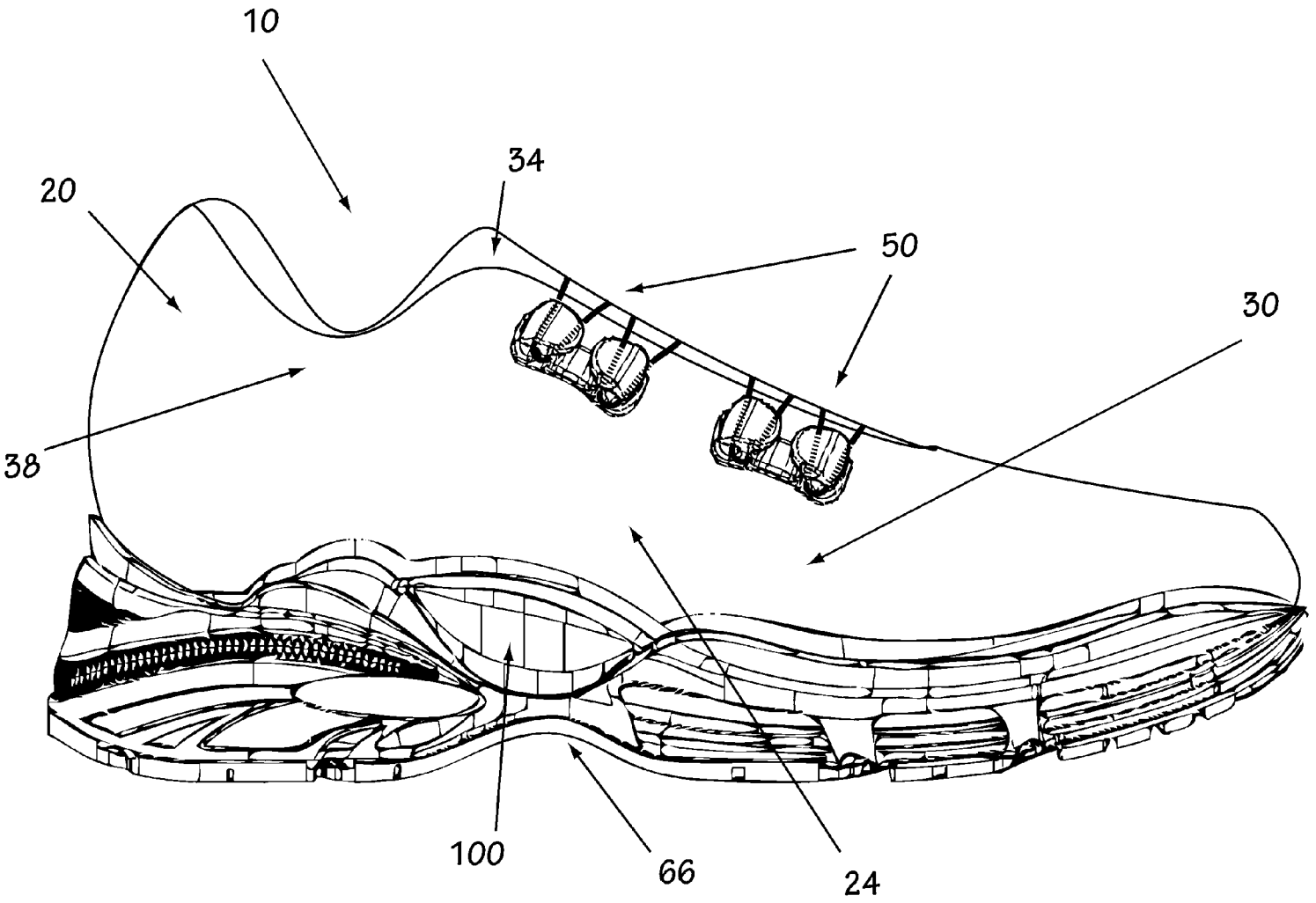
FIG. 3 is a medial side view of the article of footwear of FIG. 1.

The basic components of one embodiment of an improved article of footwear of the present invention, generally designated by reference number 10, are shown in FIGS. 1-27. As used in the description, the terms "top," "bottom," "above," "below," "over," "under," "above," "beneath," "on top," "underneath," "up," "down," "upper," "lower," "front," "rear," "back," "forward" and "backward" refer to the objects referenced when in the orientation illustrated in the drawings, which orientation is not necessary for achieving the objects of the invention.

An improved article of footwear of the invention provides a stability system for superior fit, durability, support, and strength, and is adapted to apply balanced pressure around the arch, instep and ankle. A modular cable closure system provides a mechanical advantage for adjustment to varied foot shapes. Cable fasteners are located at respective areas along the upper to provide multiple tensioning strengths for a bespoke fit. The article of footwear is designed with medial and lateral portions to assist in increasing rearfoot stability while maintaining forefoot flexibility. The rearfoot stability elements in combination with an adjustable closure system provide superior support and balance control. Each intended stability control element is designed to provide flexibility or stability where a specific function is needed. The medial and lateral stability portions of the article of footwear may be symmetrical or asymmetrical, and have features specific to differences affected by the closure system, materials, and supporting elements.

Figure 4:
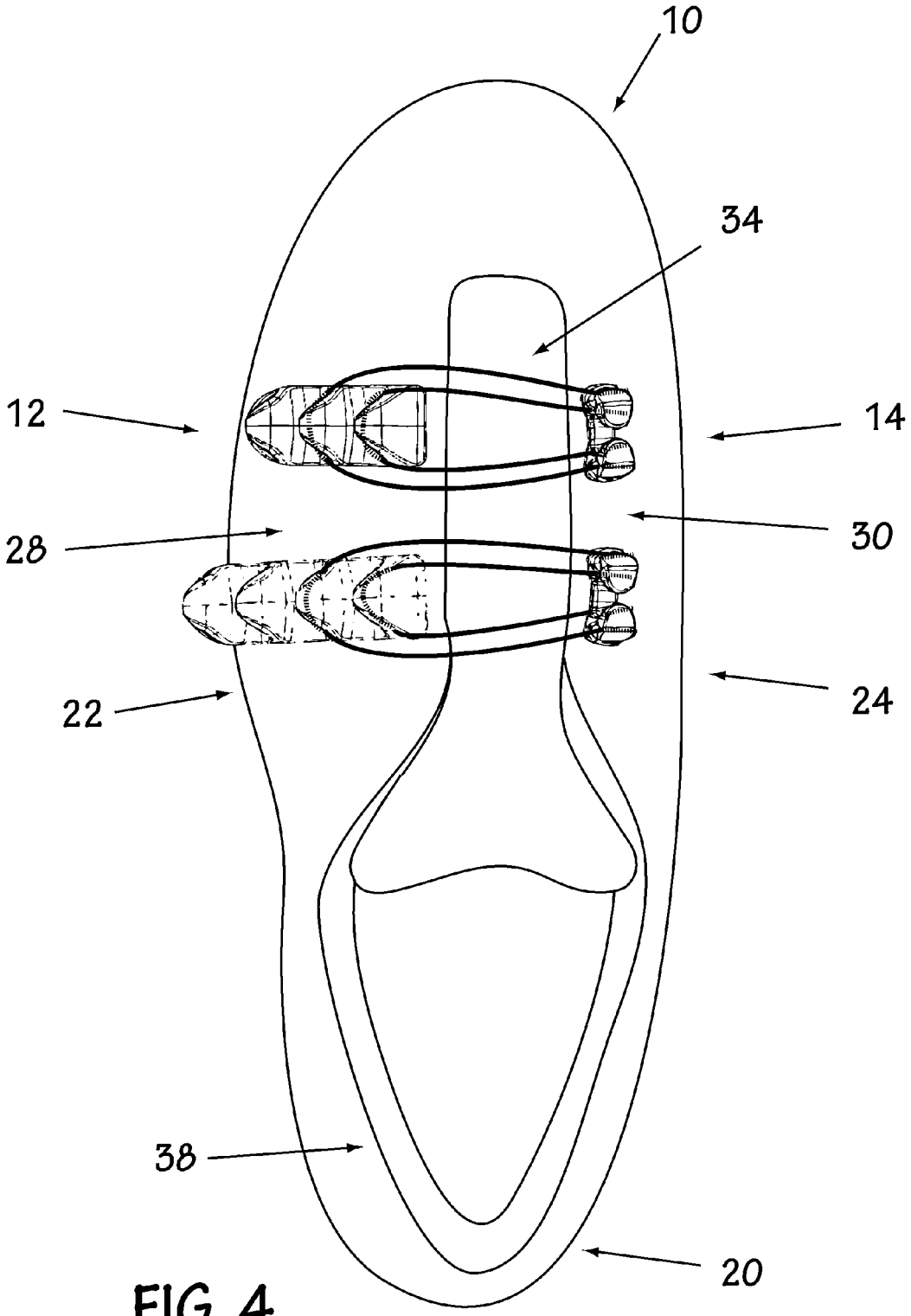
FIG. 4 is a top view of the article of footwear of FIG. 1.

As will be evident from the description below, the shoe 10 is intended to enhance performance associated with a variety of athletic activities. To accomplish this, the shoe 10 includes two halves, a lateral half 12 and a medial half 14, as shown in FIG. 4, both of which may perform very different actions. This medial-lateral division exists throughout the shoe 10. The shoe 10 includes an upper 20, shown in FIGS. 1-6, and a bottom portion 60, shown in FIGS. 7-9. It is understood that the shoe construction of the present invention may be utilized not only for an athletic type shoe, but any other shoe type.

In some embodiments, the upper is a conventional tongue and throat structure with a closure system of the present invention located on either lateral or medial side of the shoe in specific combination with a bottom stabilizing member, as described in more detail below. In additional embodiments, the upper is a sock construction with a gusseted tongue that stretches across the throat of the shoe. The gusset material may include any suitable material, such as, for example, mesh, stretch EVA and lycra, to provide a varied fit structure to the wide array of foot shapes across the arch and instep.

The upper 20 is secured to the bottom portion 60 by any suitable mechanism, such as, for example, stitching, bonding, gluing, etc. The upper 20 includes a lateral side 22 and a medial side 24, as illustrated in FIGS. 2-6, each designed for a specific function. The medial side 24 and the lateral side 22 are designed to allow the wearer a high degree of fit and stability options, and to provide as much support to the wearer's foot as desired.

The stability provided by the lateral side 22 is important because it helps to hold and support the lateral side of the wearer's foot during the high amount of lateral movement associated with supination. Accordingly, during supination when the foot rolls to the outside of the shoe, it is more desirable that the lateral side 22 is less flexible than the medial side 24.

The stability provided by the medial side 24 is important because it helps to hold and support the medial side of the wearer's foot during the high amount of lateral movement associated with pronation. During pronation when the foot rolls to the inside of the shoe, it is more desirable that the medial side 24 is less flexible than the lateral side 22. When the wearer requires both lateral and medial support, it is more desirable to have both medial side 24 and lateral side 22 less flexible to help hold and support the foot during heavy footstrikes.

Figure 5:
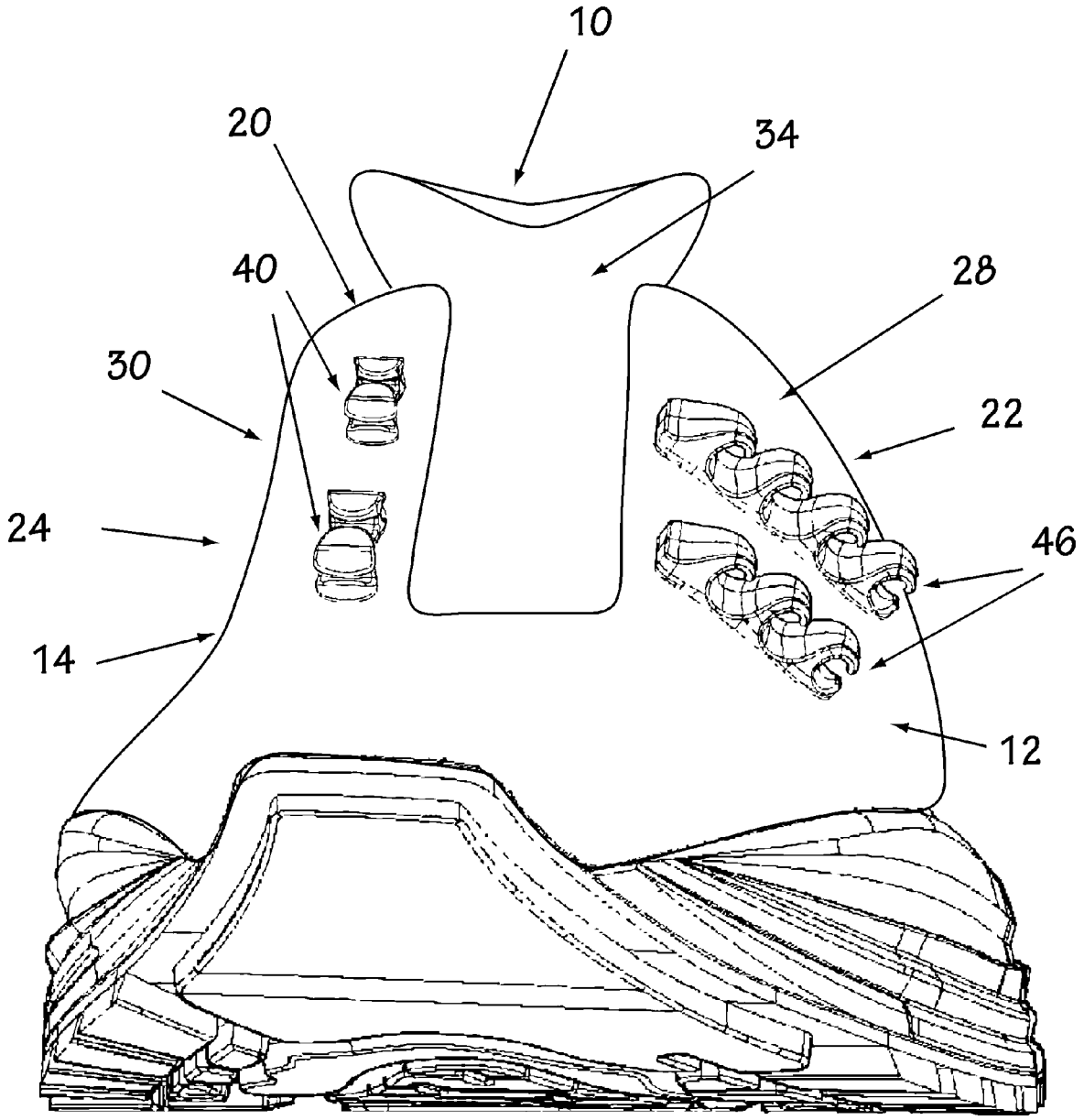
FIG. 5 is a front view of the article of footwear of FIG. 1.
Figure 6:
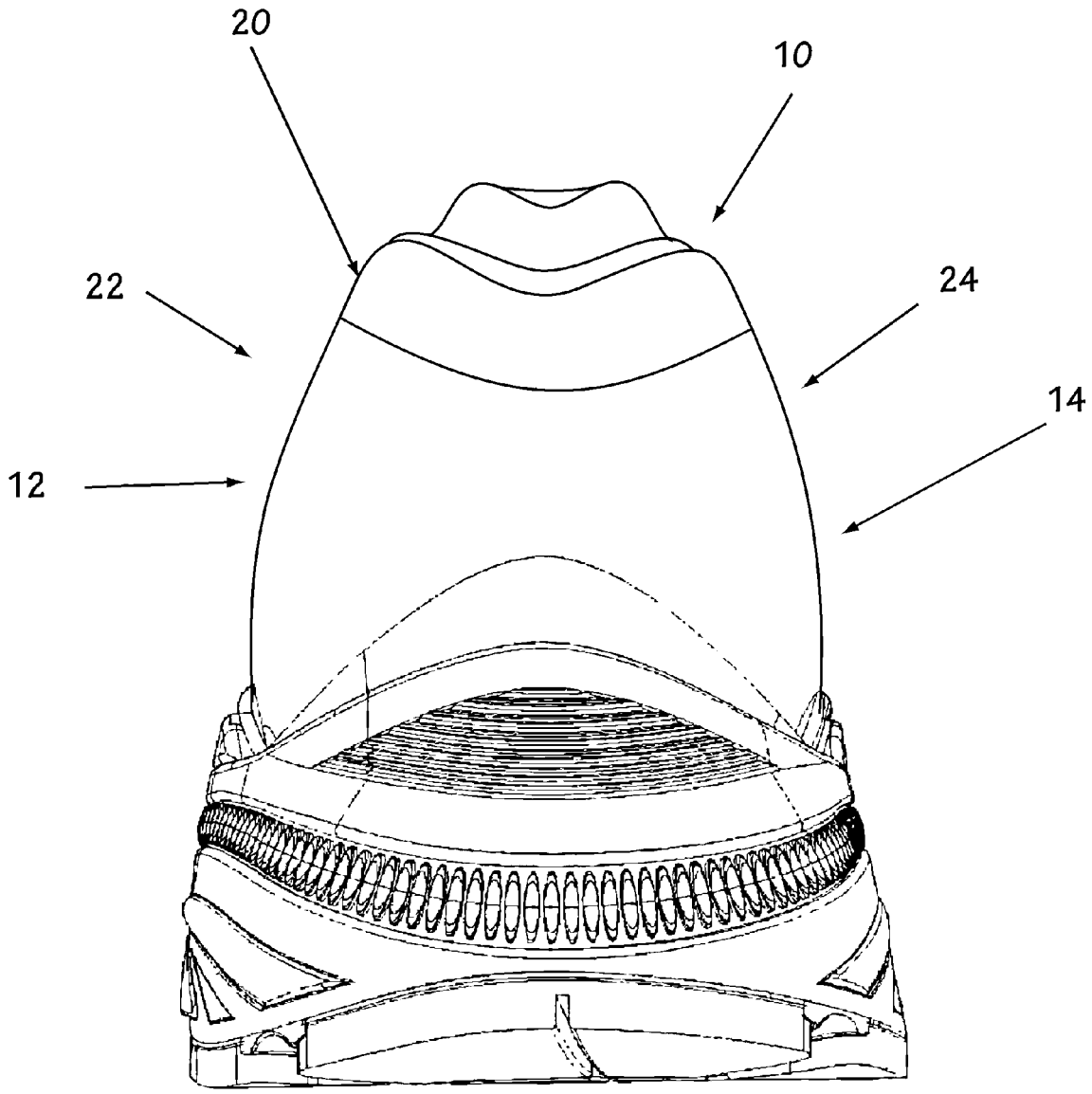
FIG. 6 is a rear view of the article of footwear of FIG. 1.
Figures 7, 7A:
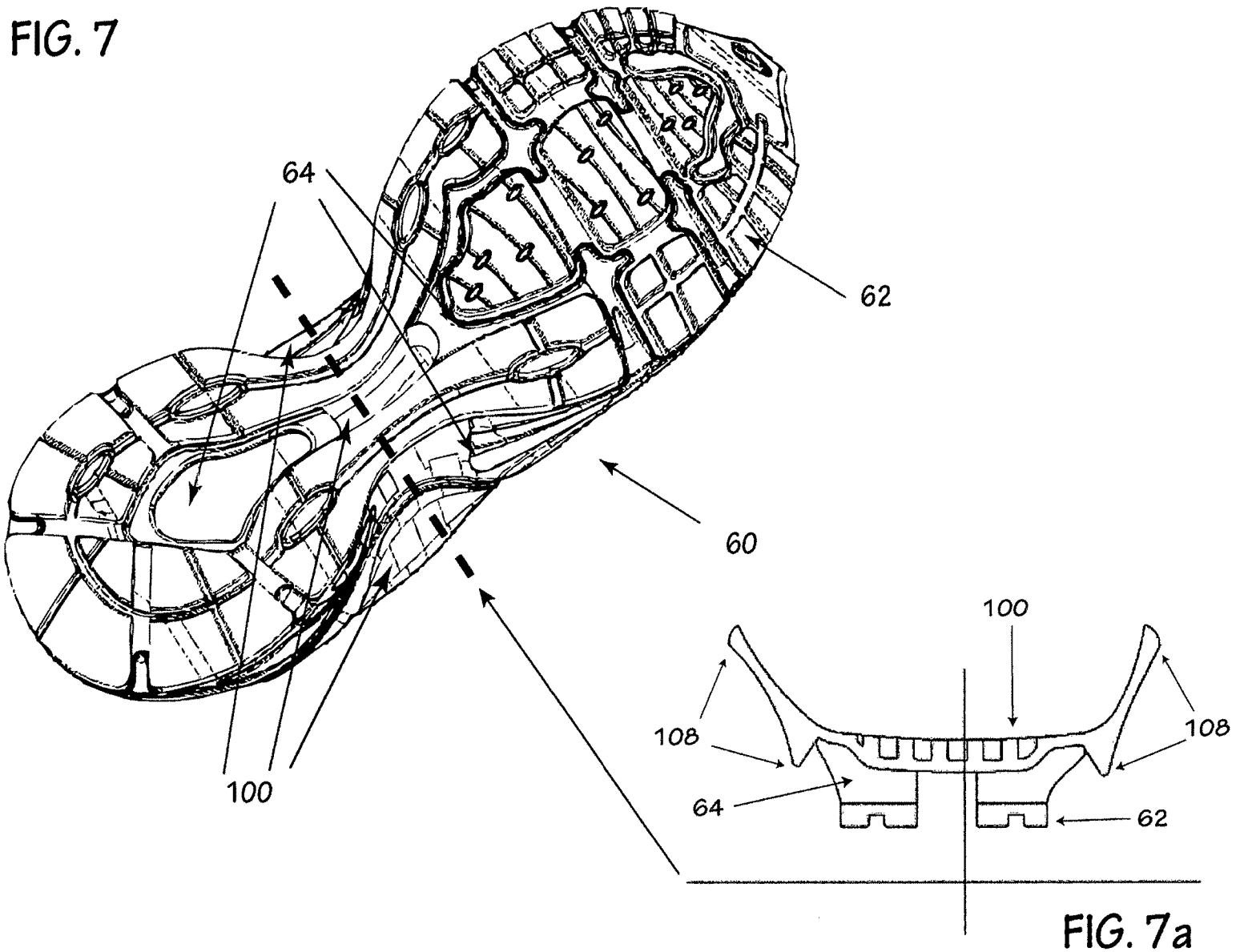
FIG. 7 is a bottom perspective view of the article of footwear of FIG. 1.

The upper 20 includes a lateral side panel 28 and medial side panel 30 that cover respective sides of the upper between the midsole 64 and the throat region 34 of the upper 20, as shown in FIGS. 4-5. The lateral side panel 28 and the medial side panel 30 are preferably made from a lightweight breathable synthetic material having minimal stretch capability, and may be air mesh, sandwich mesh, polyester, nylon, polyurethane, embossed or injected or any other suitable material. In some advantageous embodiments, the throat region 34 and collar region 38 are made from a lightweight breathable synthetic material having a higher stretch capability to accommodate a wide variety of foot shapes. Materials located in the throat region 34 and collar region 38 may include lycra, stretch mesh, stretch EVA, a combination thereof, or any other suitable synthetic or natural material.

FIGS. 7-11 illustrate the bottom portion 60 of the footwear article that includes an outsole 62, a midsole 64, and a stabilizing member 100. The bottom 60 further includes an arch section 66 located between a heel portion and a forepart portion of the bottom 60. The stabilizing member 100 is secured between the bottom portion 60 and the upper 20. FIG. 7*a* shows a cross-section along line 7*a* of the bottom arch. As seen in FIG. 7*a*, each upright support member 108 outwardly extends from an outermost lateral surface of the midsole 64 that is perpendicular to a plane representing a bottom surface of the outsole 62 and includes a bottom portion that curves beneath a bottom surface of the stabilizing member 100 that is adjacent to the arch portion 66.

When the foot of a typical runner wearing the shoe of the present invention contacts the ground along the lateral heel area, the heel and forefoot portions of the bottom portion 60 pivot with respect to each other such that they axially move with the foot along the foot's axis of pronation. During the rapid actuation of the midsole 64 associated with running, the midsole arch portion 66 of the shoe freely moves axially, allowing the stabilizing member 100 to constrict around the arch 66 as pressure is exerted on the shoe in a downward direction as the shoe contacts the ground surface. Then, as the pressure is released when the foot relaxes in its recovery phase, the stabilizing member 100 returns to its resting state. However, the foot remains fully supported along the longitudinal length of the stabilizing member 100 in a neutral configuration, as described in more detail below. Moreover, because the stabilizing member 100 longitudinally supports the arch of the foot, the need for heavy and durable sole material and a cost prohibitive custom insert orthotic in the arch area is obviated, thereby resulting in a light weight and more economical shoe.

The arch 66 is designed to allow the outsole 62 and the midsole 64 to work in union with the stabilizing member 100 and cable closure system described in more detail below. The arch 66 performs similarly to a pre-tensioned tendon between the heel and forepart portions of the bottom 60. As the shoe 10 strikes the ground at the outsole 62, the foot places a downward load on the stabilizing member 100, which distributes the load across the arch 66. As the arch 66 compresses downward, it dissipates energy as it absorbs the impact, and then stores its inherent elastic energy in a stretched state and releases it back to the foot during the recovery phase of the stride. The arch 66 expands and contracts in a tendon-like movement as the downward load is applied and removed with each footstrike the wearer makes.

Figure 8:
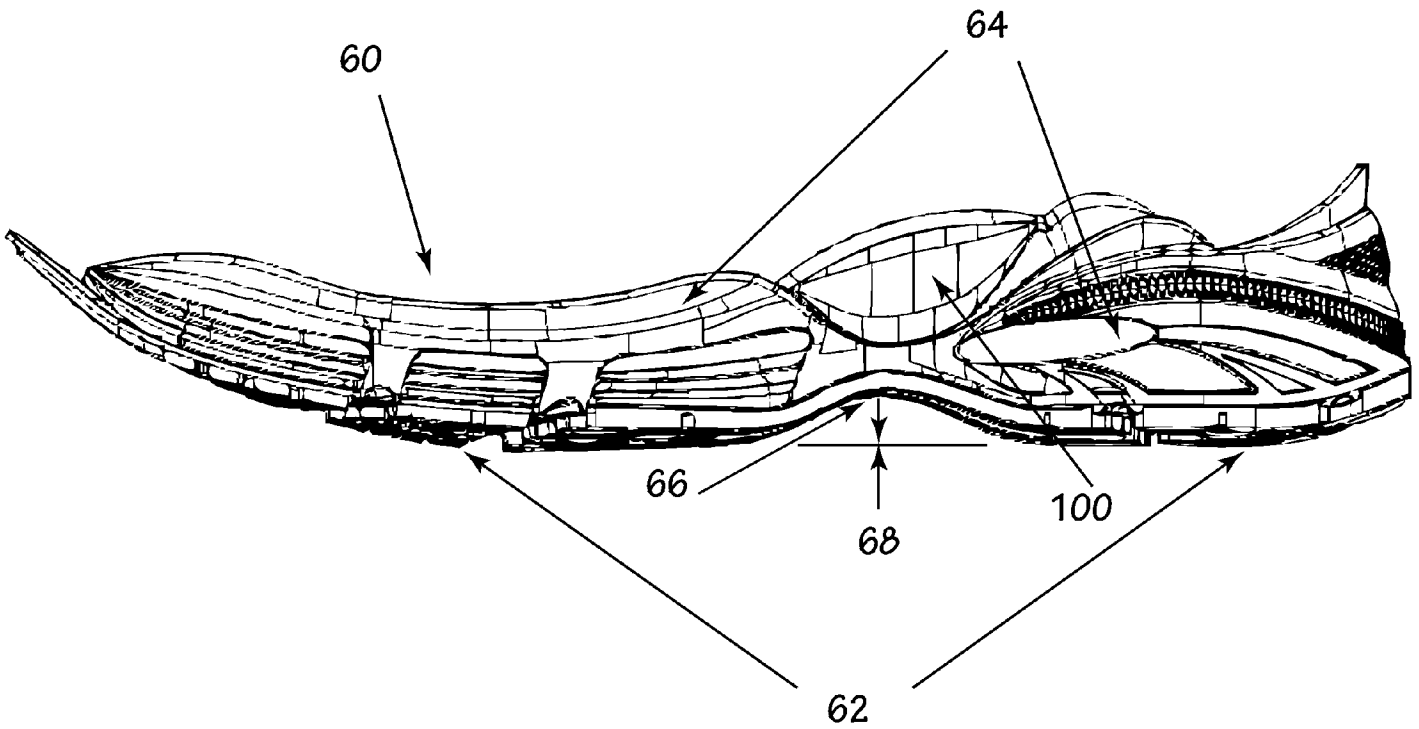
FIG. 8 is a lateral side view of the bottom part of the article of footwear of FIG. 1.

FIG. 8 illustrates the arch 66 in its resting state. As the bottom 60 loads up with potential energy, the arch 66 moves downward and absorbs energy in the midsole 64 and outsole 62 and a compressed arch 68 now loaded with potential energy releases stored energy in the elastic properties of the midsole, shank member and outsole material into an upward direction thereby assisting the wearer with a more efficient power stride. The region of the arch 66 may include any suitable materials that have high elastic properties.

Figure 9:
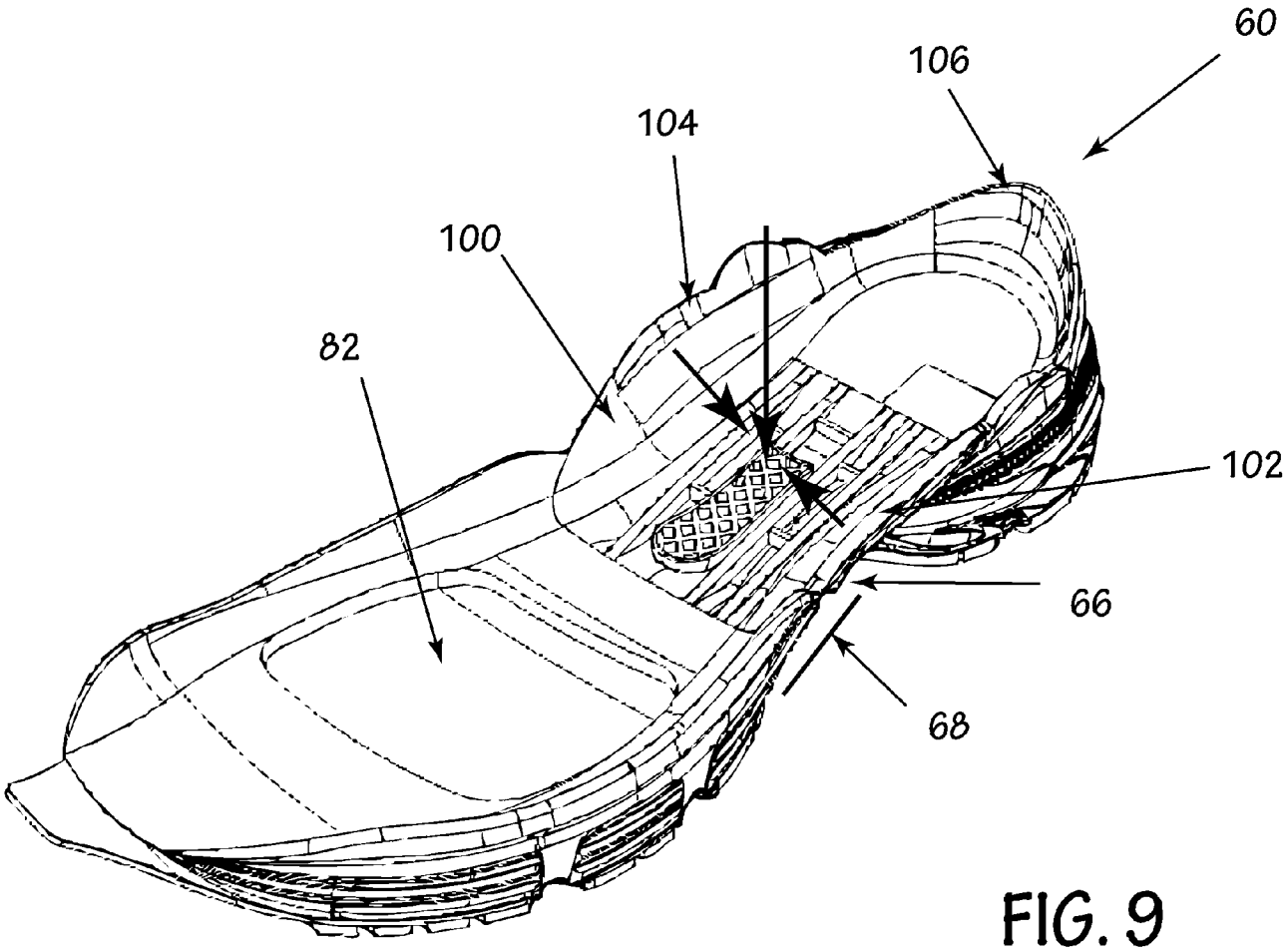
FIG. 9 is a top perspective view of the bottom part of the article of footwear of FIG. 1.

FIG. 9 shows how the downward force applied by the wearer effects the stabilizing member 100. As the stabilizing member 100 loads, the upright lateral stability member 102 and the upright medial stability member 104 actuate inward and provide the wearer with added arch and instep support thereby obviating the need for a costly insert orthotic.

Figure 11:
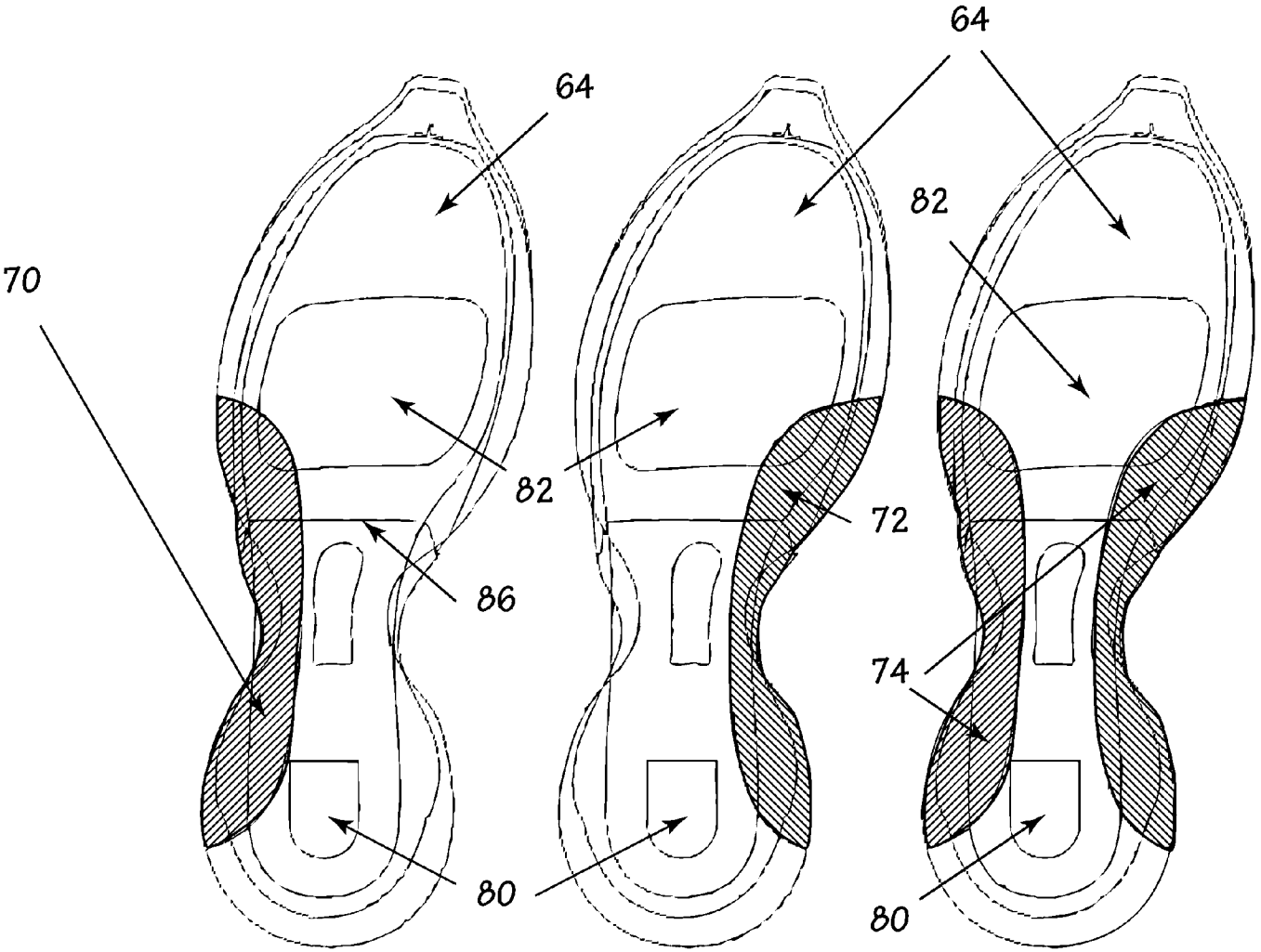
FIG. 11 is a top view of the midsole of the article of footwear of FIG. 1, including a stability post for each of the three gait patterns.

FIG. 11 illustrates three embodiments of the midsole 64 that provide stable adjustment for the three most common footstrike patterns. As shown on left, the midsole 64 includes a lateral posting 70, which provides a lateral stability support. The middle figure shows the midsole 64 with a medial posting 72, which provides a medial stability support. The figure on the right illustrates the midsole with a neutral posting 74 which provides the wearer with a neutral stability support. The posts 70, 72 and 74 are preferably of greater hardness than other areas of the midsole 64. It is understood that a midsole without the posts 70, 72, 74 may also be used in accordance with the present invention.

Figure 10:
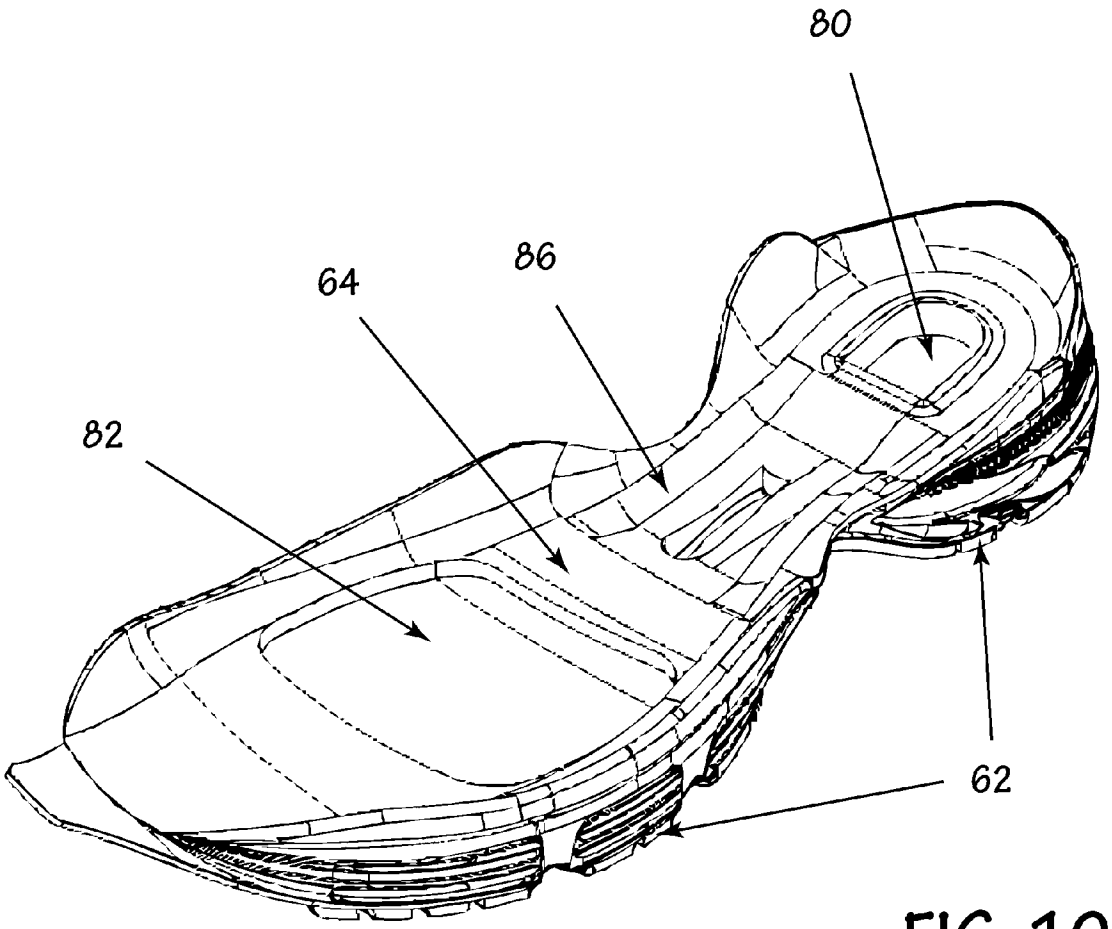
FIG. 10 is a top perspective view of midsole and outsole of the article of footwear of FIG. 1.

The stabilizing member 100 is seated within a recessed area 86 of the midsole 64, as shown in FIGS. 10 and 11. The midsole 64 includes a heel plug 80 to dampen heelstrike impact and a high rebound forepart plug 82 to assist in faster toe off transition. The stabilizing member 100 matches the contour of the upper 20 along its medial side of the arch 66 and its lateral side of the arch 66, which extend from a portion of the heel to a portion of the ball of the foot. In certain advantageous embodiments, the fore portion of the stabilizing member 100 is positioned such that it occupies a space behind the ball of a foot. The stabilizing member 100 sweeps upwardly and adjacent to the medial and lateral sides of the foot so that it provides stability and support for a footstrike. As downward pressure is placed on the stabilizing member 100, the support structure constricts inwardly towards its center line to provide stable control along the axial pronation direction.

The stabilizing member 100 may be designed in a variety of configurations, as further illustrated and discussed below in connection with FIGS. 20-26.

Figure 20:
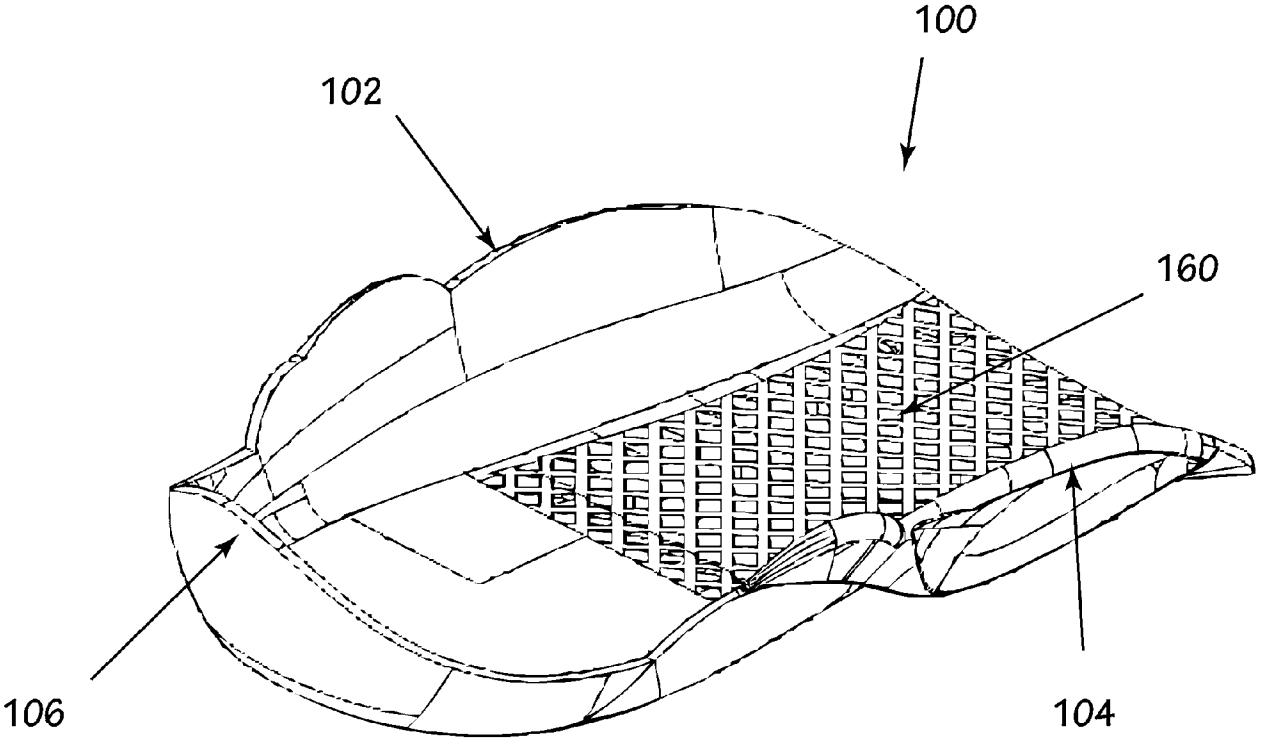
FIG. 20 is an isometric view of a stability member shank of the article of footwear of FIG. 1, shown with a crosshatch pattern.

FIG. 20 shows a stabilizing member 100 with a lateral support portion 102 and a medial support portion 104. This configuration, together with the midsole 64 and the lateral and medial posts 74 shown in FIG. 11, provide for optimum neutral stability.

Figure 21:
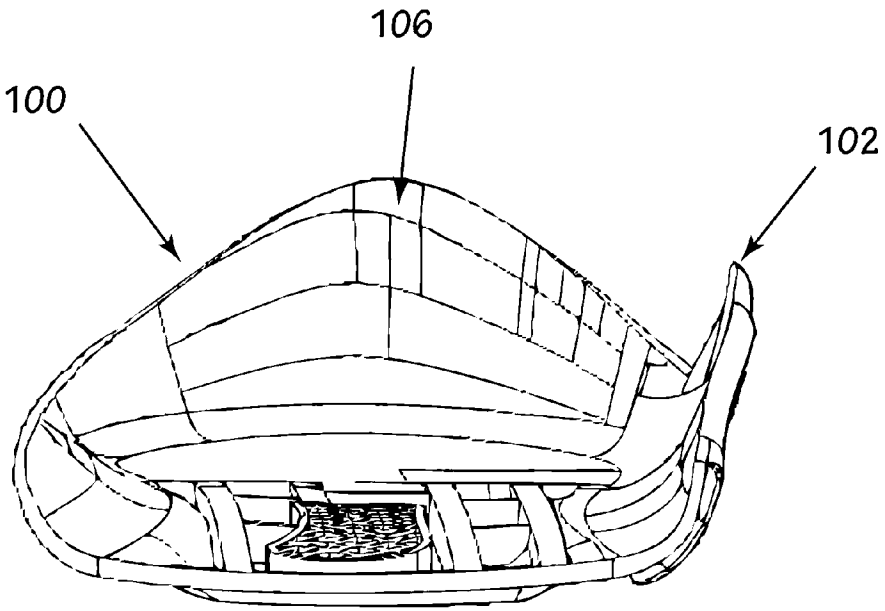
FIG. 21 is a front view of the stability member of the article of footwear of FIG. 1, shown with lateral control.

In the embodiment of the stabilizing member 100 shown in FIG. 21, the lateral support portion 102 is present, but the medial support portion 104 is removed or minimized. This configuration of the stabilizing member 100, together with the midsole 64 and the lateral post 70 shown in FIG. 11 provide for optimum underpronation (supination) stability, where the foot tends to roll outward.

Figure 22:
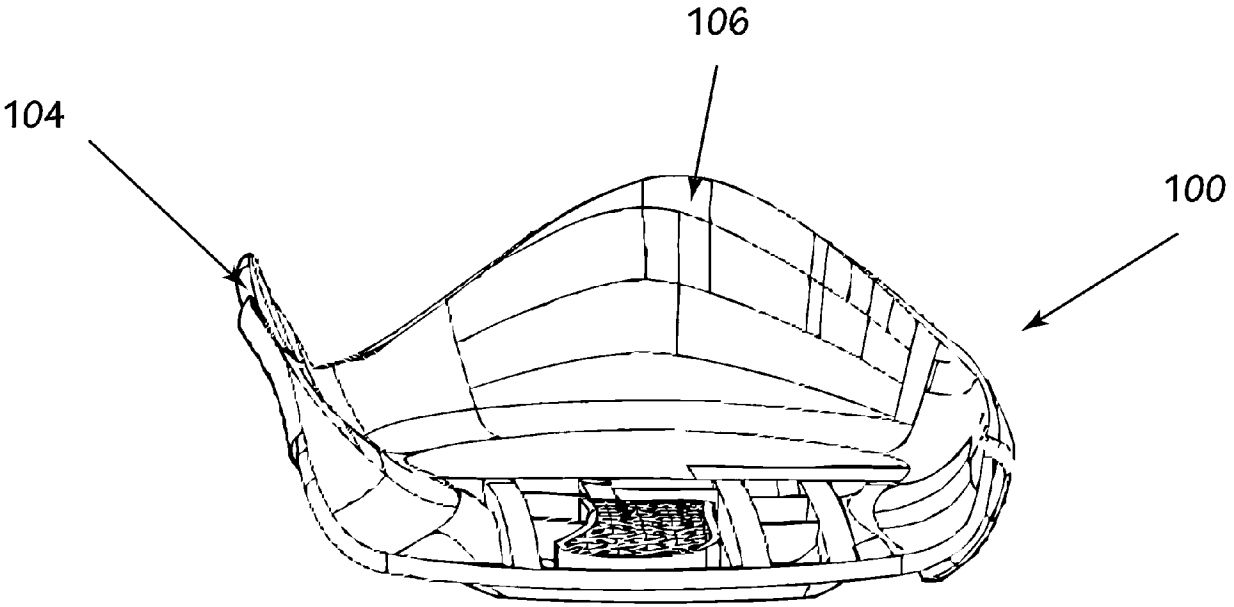
FIG. 22 is a front perspective view of the stability member of the article of footwear of FIG. 1, shown with medial control.

In the embodiment of the stabilizing member 100 illustrated in FIG. 22, the medial support portion 104 is included, but the lateral support portion 102 is removed or minimized. This configuration of the stabilizing member 100, together with the midsole 64 and the medial post 72 shown in FIG. 11, provide for optimum overpronation stability, where the foot tends to roll inward.

The stabilizing member 100 shown in FIGS. 20-22 also includes a base portion 160 an upright heel portion 106 to allow for a stable heel position. The upright heel portion 106 is positioned on a rearmost upper edge of the stabilizing member 100, the rearmost upper edge shaped to form a curved apex that outwardly extends upward further than a remainder of the upright heel portion 106. The advantage of three different configurations of stabilizing members 100 shown in FIGS. 20-22 is that they allow for precise tailoring of the stabilizing member to a corresponding footstrike pattern determined by professional gait analysis.

Figure 26:
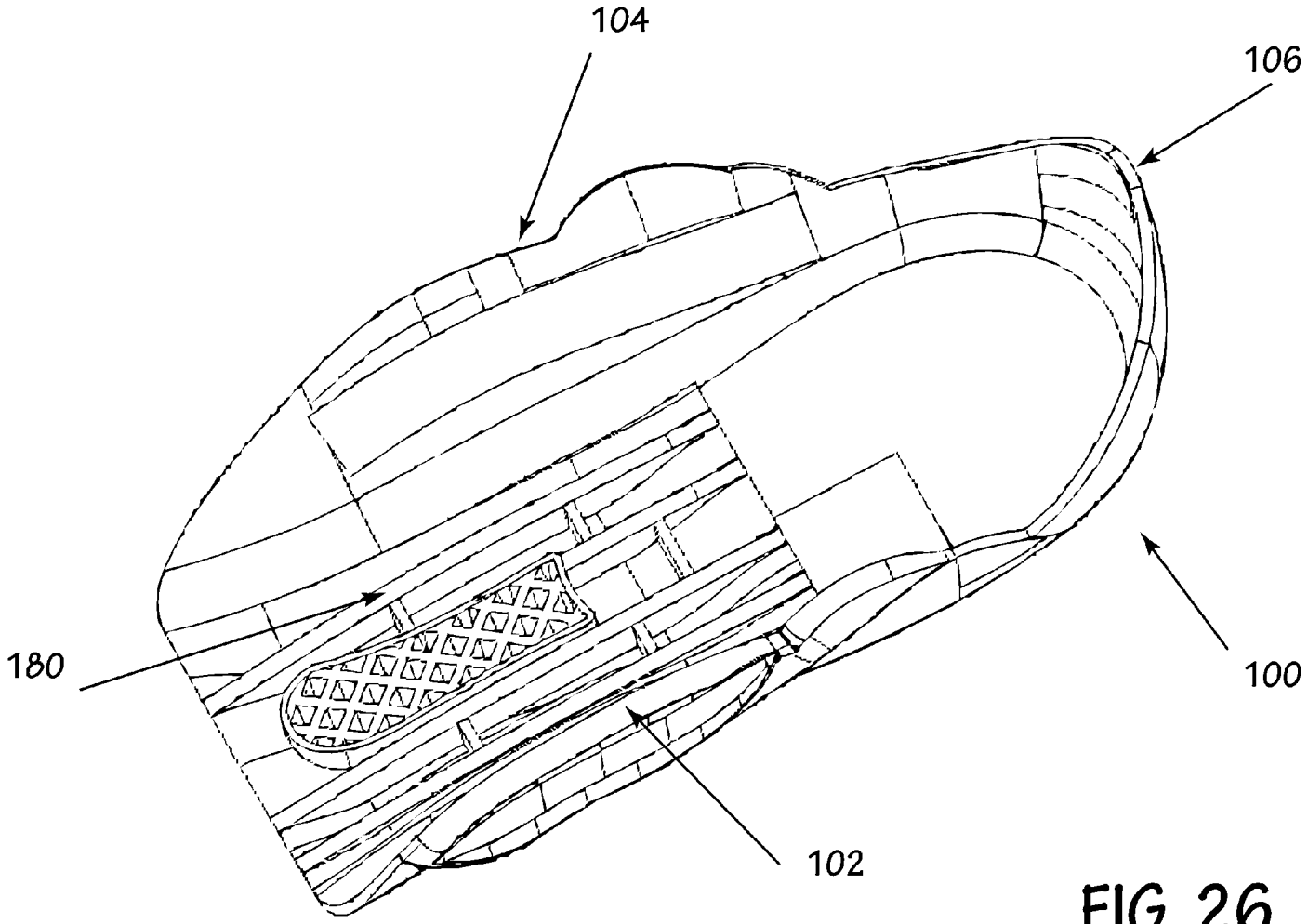
FIG. 26 is a top isometric view of the stability member of the article of footwear of FIG. 1, shown with rib supports.

It should be noted that, while FIG. 20 illustrates the stabilizing member 100 with a cross hatch design on the base portion 160 to provide for lesser flexibility, other designs may be utilized in accordance with the present invention, depending on a user's preference. For example, as shown in FIG. 26, the stabilizing member 100 may have a rib design 180 to allow for greater flexibility. A lighter wearer may prefer a more flexible shank, and a heavier wearer may prefer a less flexible shank. The stabilizing member 100 may be utilized in a variety of flexibility configurations whether in cross hatch 160, rib 180, or any other suitable design depending upon performance requirements.

Figure 23:
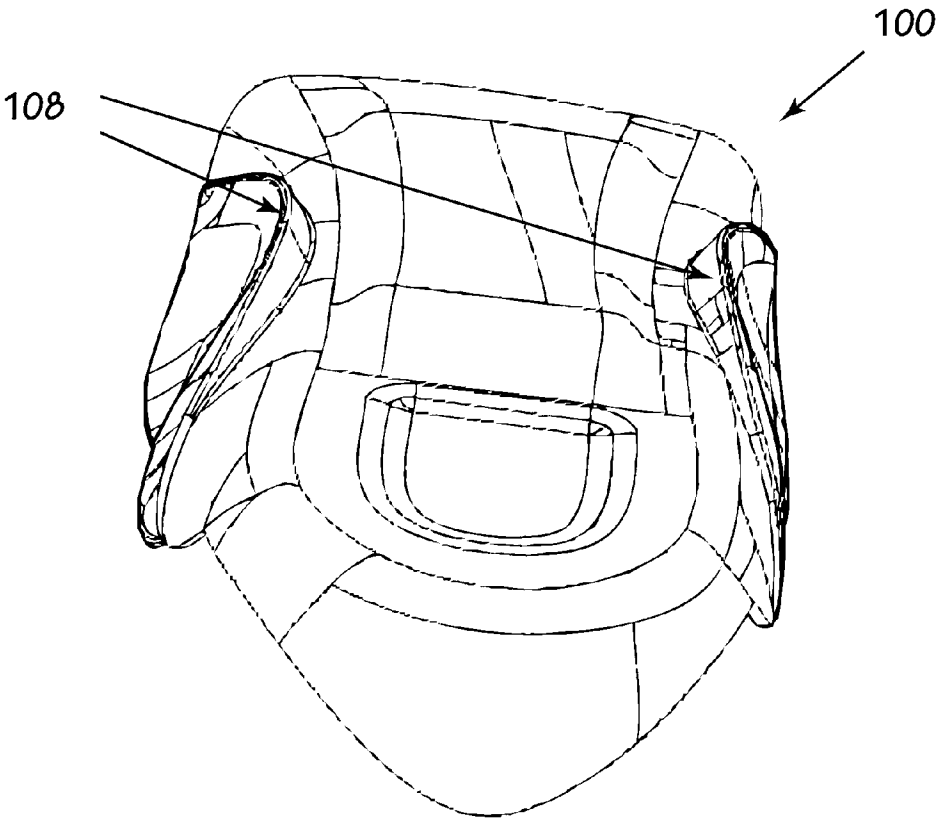
FIG. 23 is a bottom isometric view of the stability member of the article of footwear of FIG. 1.
Figure 24:
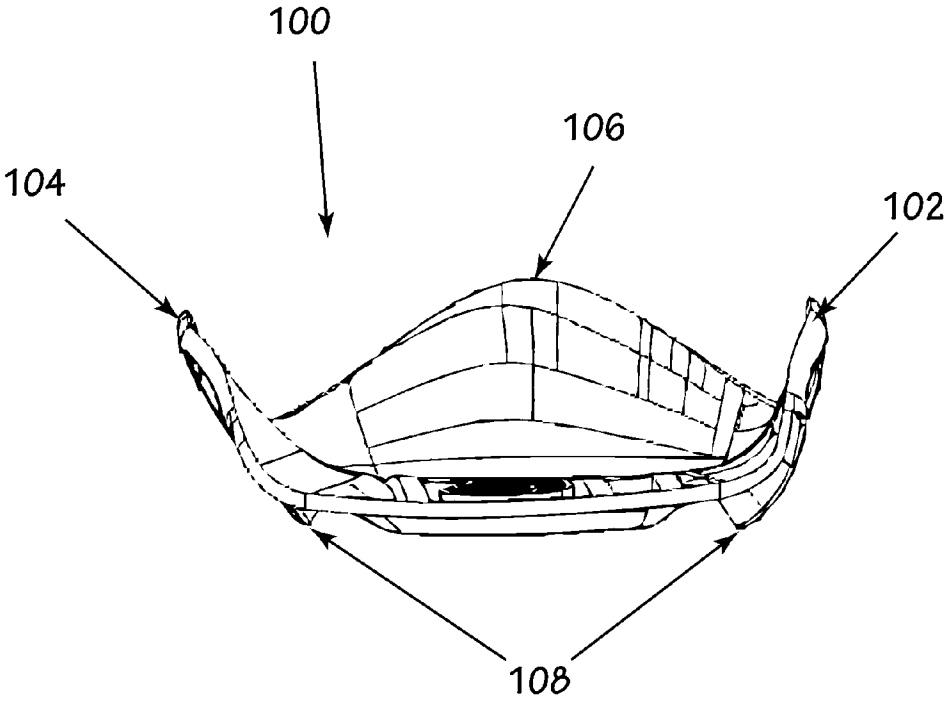
FIG. 24 is a front view of the stability member of the article of footwear of FIG. 1, shown with lateral and medial controls.
Figure 25:
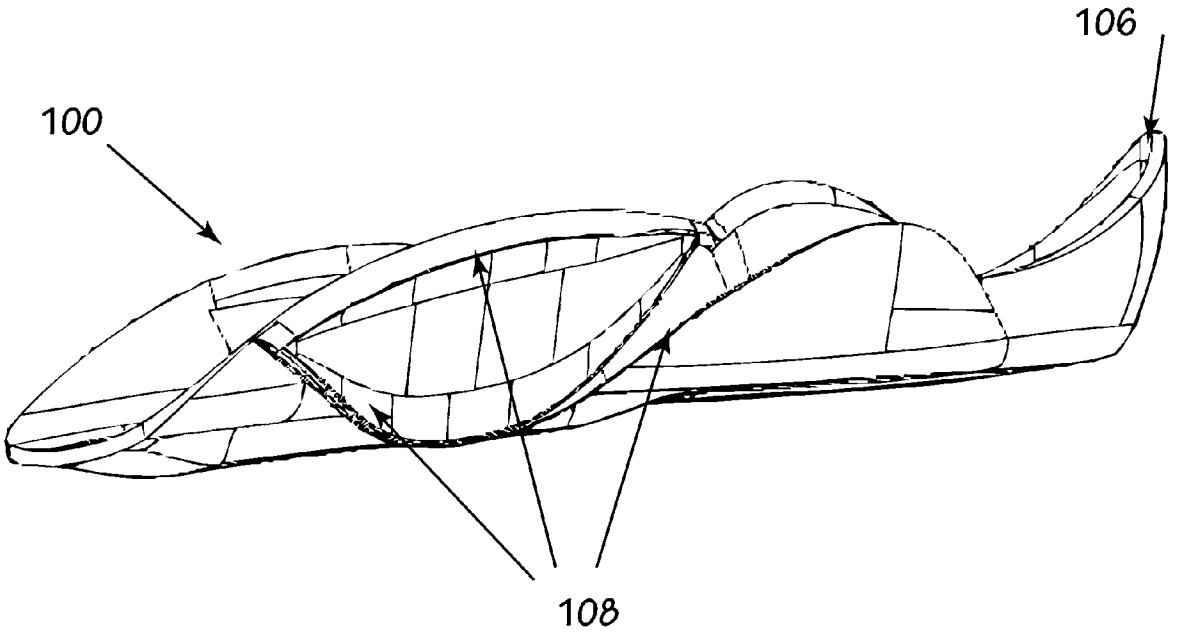
FIG. 25 is a lateral side view of the stability member of the article of footwear of FIG. 1.

FIG. 23 illustrates the bottom surface of the stabilizing member 100, which is designed to transfer forces between the bottom portion 60 and the upper 20. The bottom surface of stabilizing member 100 matches mating surfaces with the bottom 60 and the upper 20. As shown in FIGS. 23-25, the stabilizing member 100 may also include perimeter reinforced lateral and medial upright support members 108. In the arch portion 66 of the midsole 64, each upright support member 108 outwardly extends from and past an outermost lateral surface of the midsole 64 perpendicular to a plane representing a bottom surface of the outsole 62. Further, each upright support member 108 includes a bottom portion that extends downwardly past a central portion of a bottom surface of the stabilizing member 100 that is adjacent to the arch portion 66 of the midsole 64 of the bottom member 60. This design removes excess weight from the stabilizing member and promotes an even inward motion towards the member's centerline for maximum contraction as the wearer actuates the bottom 60.

Figure 12:
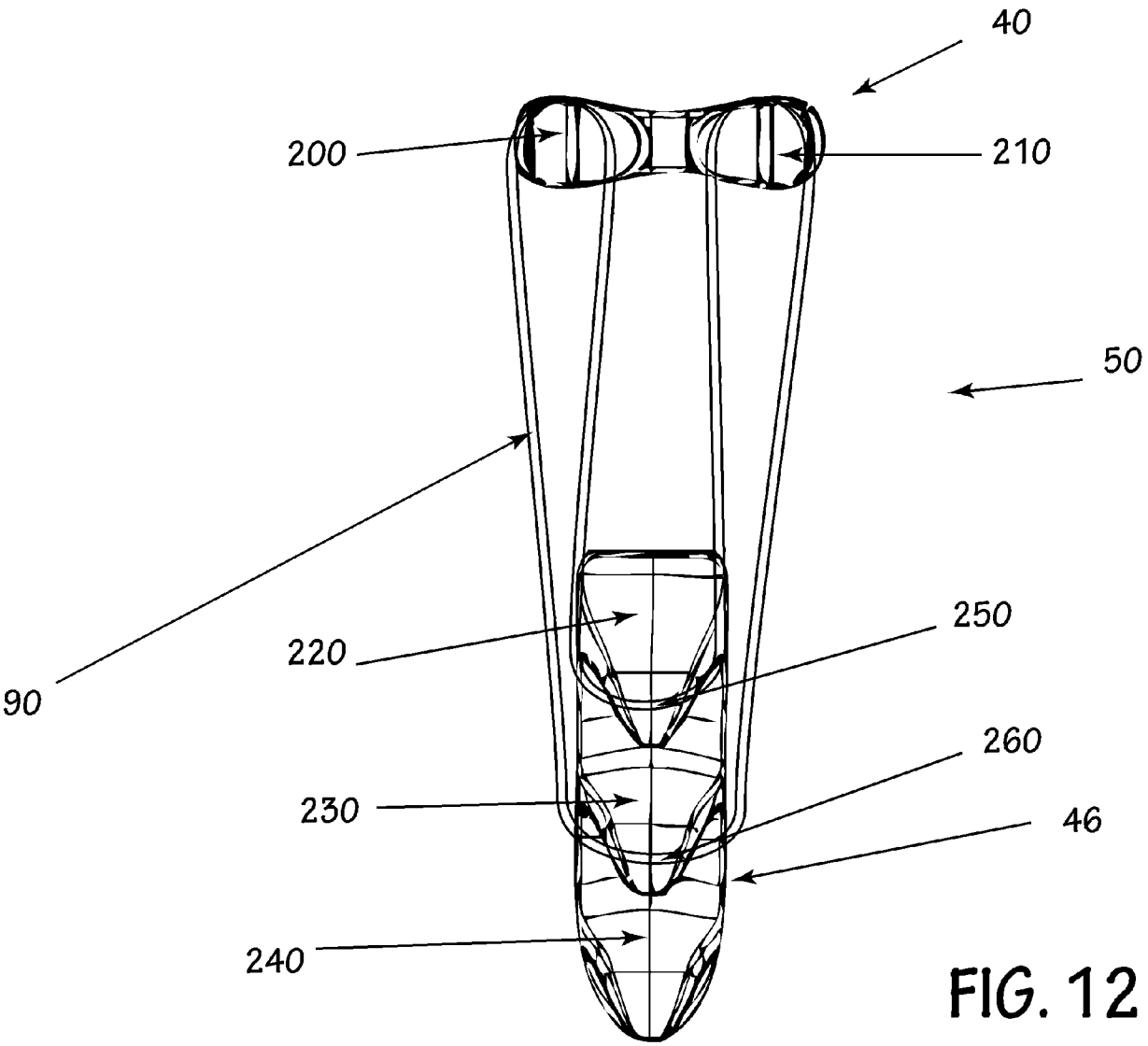
FIG. 12 is a top view of a portion of the cable closure system of the article of footwear of FIG. 1.
Figure 13:
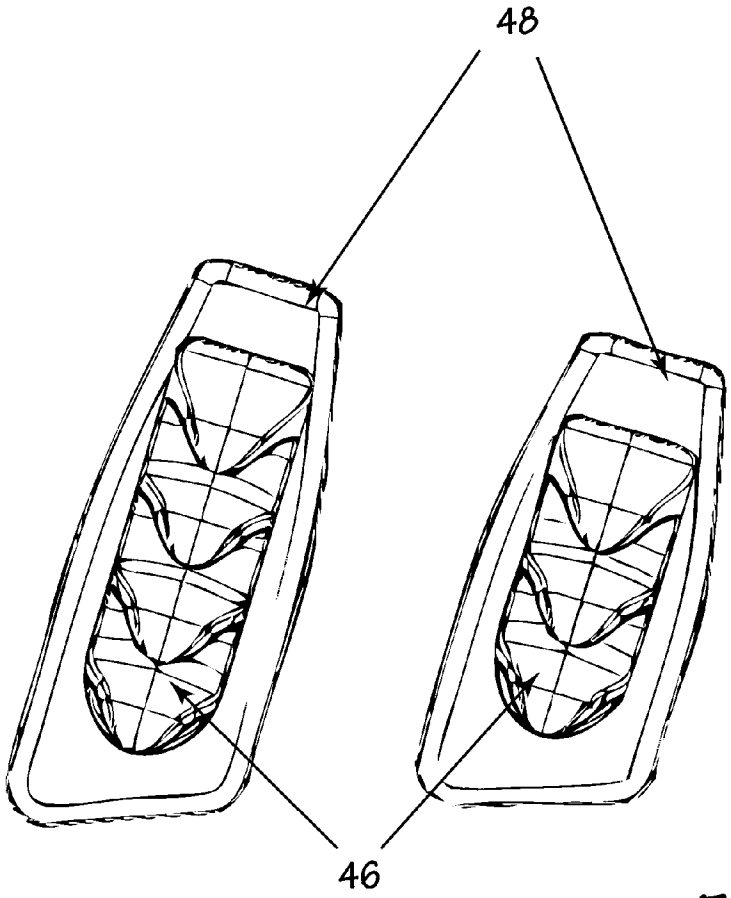
FIG. 13 is a top view of the cable guide/anchor members of the article of footwear of FIG. 1, showing the cable guide/anchor members attached to a base plate.
Figure 14:
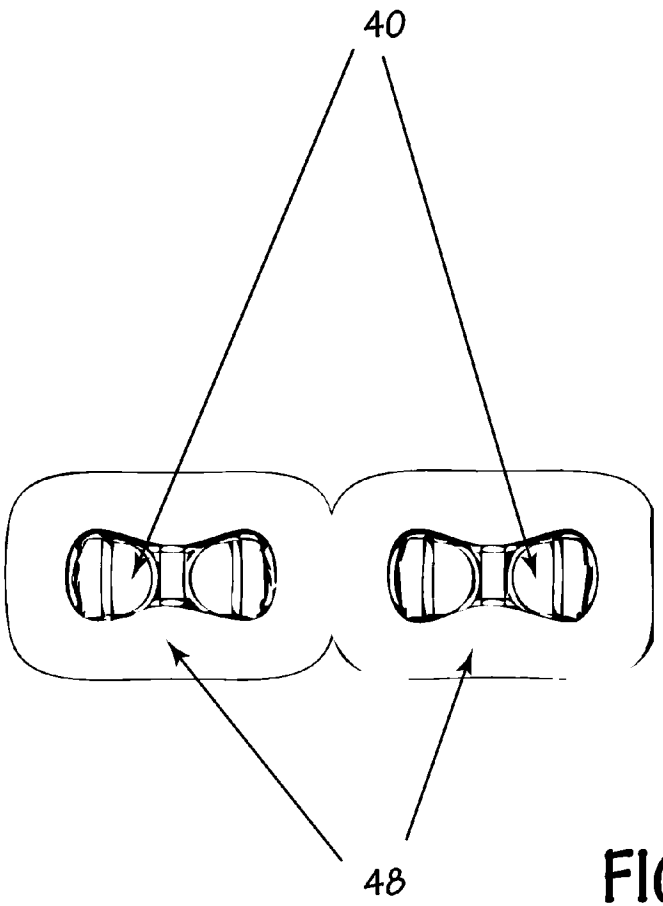
FIG. 14 is a top view of the cable guide members of the article of footwear of FIG. 1, showing the cable guide members attached to a common base plate.

The footwear article 10 of the present invention further includes a closure system 50, as illustrated in FIG. 12. The closure system 50 includes a guide member 40, a fastening member 46 positioned opposite the guide member, and a cable assembly 90 connecting the guide member 40 and the fastening member 46. The guide member 40 has a first groove portion 200 and a second groove portion 210. The fastening member 46 has a first tensioning member 220, a second tensioning member 230, and a third tensioning member 240. It is understood that other configurations of the fastening member 46 may be used, as described further below. Any suitable materials may be used for the guide member and the fastening member, including molded TPU, Nylon ABS, Nylon PA6, Arkema BZM 1, BZM 10, BZM 30, BASF TPU 85A, Pebax, EMS LX9012, or a combination thereof, or other reinforced injection molded materials, or other suitable thermoplastic materials.

In the embodiment illustrated in FIG. 12, the cable assembly 90 is a closed-loop cable that is routed through the first and second groove portions 200, 210 of the guide member 40 and the first and second tensioning members 220, 230 of the fastening member 46 to tension the upper around the wearer's foot. The cable 90 may be formed of a variety of suitable material with a low friction coefficient that may be of differing length, strength, elasticity, and diameter, and may be freely substituted in order to meet the specific demands of the wearer's unique physiology. For example, the cable 90 may be formed of a low friction polymer having a relatively low elasticity and high tensile strength, or an elastic polymeric cable, or a multi-strand metallic cable, preferably with a low friction polymer casing. In some advantageous embodiments, the cable may be comprised of a material from the group consisting of nylon, braided metallic cord, natural cord, lace, polyurethane, polyester, co-extruded thermoplastics, elastic material, spun material, braided material, NBR, neoprene, silicone, FKM, TFE/P, HNBR, PTFE, a combination thereof or similar material.

Figure 17:
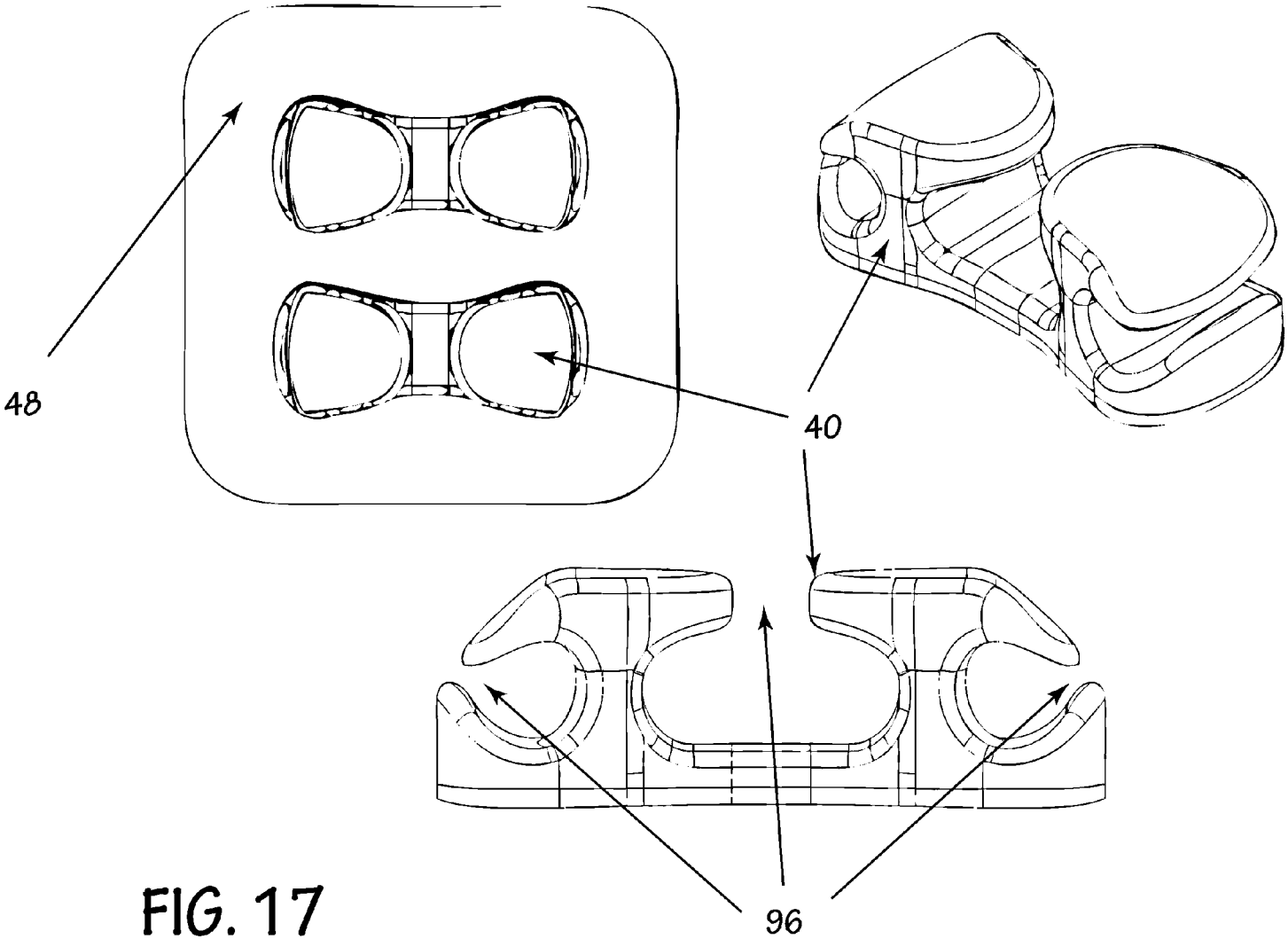
FIG. 17 are top, front and isometric views of the cable guide members of the article of footwear of FIG. 1, shown in a multiple configuration.
Figure 18:
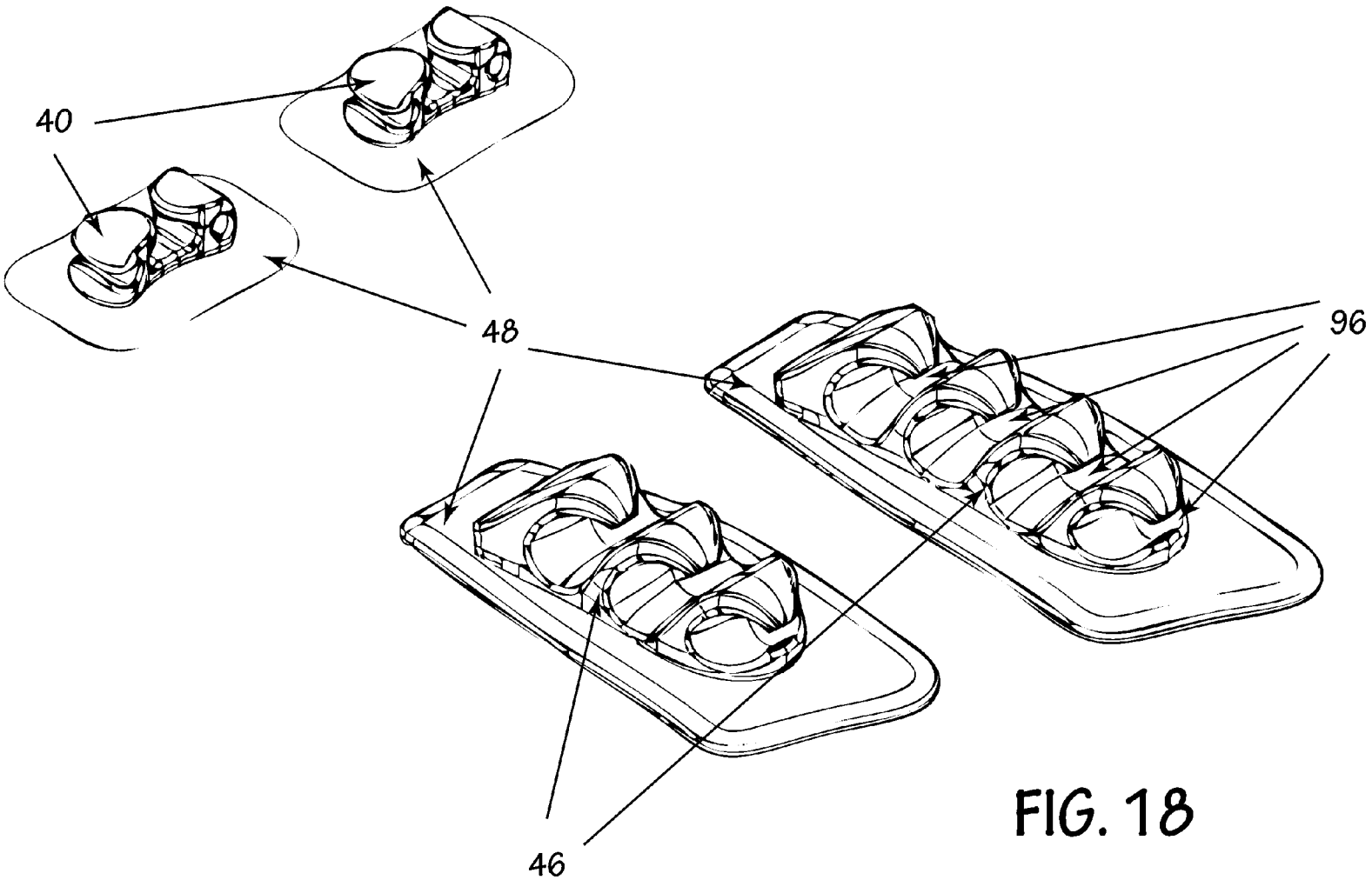
FIG. 18 is an isometric view of the cable guide members and anchor members of the article of footwear of FIG. 1, showing the cable guide members and anchor members as separate units.
Figure 19:
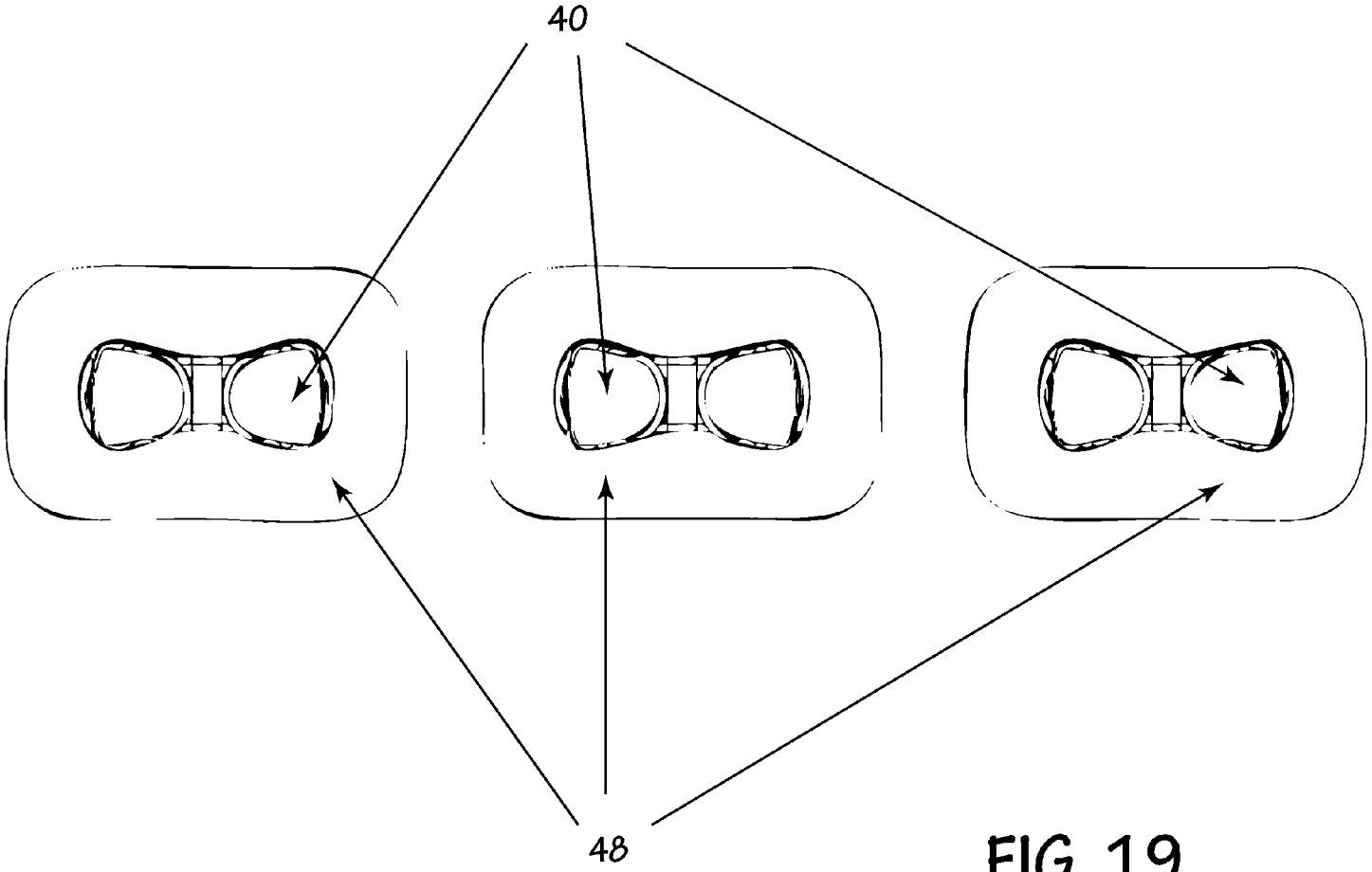
FIG. 19 is a top view of the cable guide members of the article of footwear of FIG. 1, showing the cable guide members as separate units.
Figure 27:
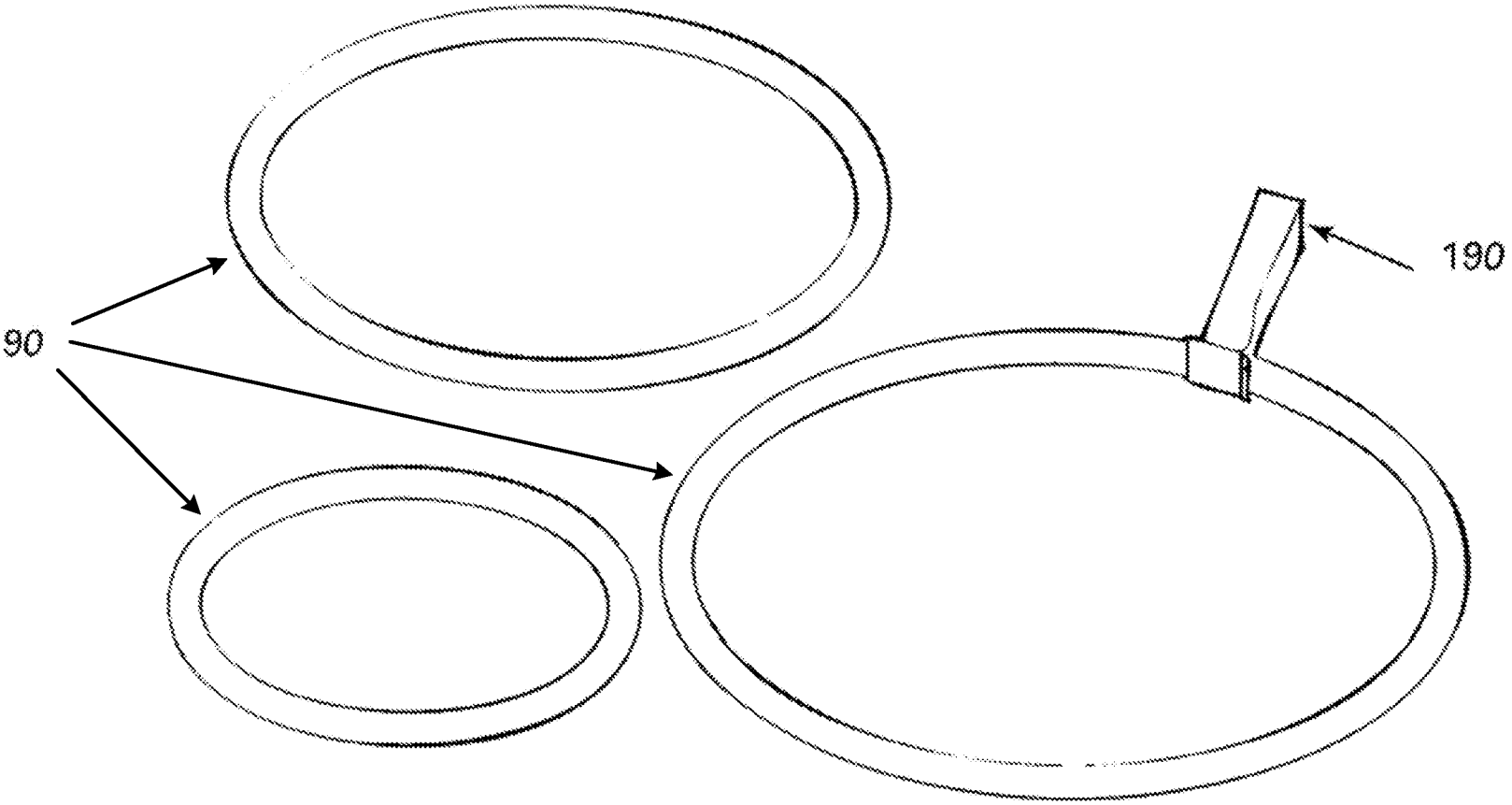
FIG. 27 is an isometric view of cables of the article of footwear of FIG. 1, shown in multiple lengths.

In some embodiments, the cable 90 may be freely substituted with a different cable having a desired length or desired flexibility. In one advantageous embodiment, as shown in FIG. 27, the shoe 10 is sold with a plurality of cables 90 having different lengths and/or flexibilities. The guide member and the fastening member allow the cable assembly to snap fit 96 into place for positive retention against accidental release, as illustrated in FIGS. 17-18. Once the desired length and flexibility of the cable 90 is determined, a repeatable fit and function far outweighs the guessing that is involved when a conventional lace shoe is used to determine the proper amount of tension about the upper 20.

As shown in FIG. 27, the cable assembly 90 may include a gripping member 190, such as a pull tab, to assist the wearer in opening the closure system 50 to doff the shoe. The gripping member 190 may be made with any suitable material, such as nylon or PE.

In additional advantageous embodiments, the cable assembly 90 has a first end, a second end and a cable portion. The first and second ends are secured to the fastening member 46 and the cable portion extends through the first groove portion 200 of the guide member 40, at least one of the tensioning members of the fastening member 46, and the second groove portion 210 of the guide member 40.

The guide member 40 and the fastening member 46 are sewn or otherwise attached to either the lateral side panel 28 or the medial side panel 30 of the upper 20, or both, as shown in FIGS. 4 and 5, to provide independent adjustable support in the forefoot region. In some embodiments, such as illustrated in FIGS. 1-5, the shoe 10 has two closure systems and the fastening member 46 of the first closure system and the second closure system may be located on the same lateral side panel 28, or on the same medial side panel 30. In additional embodiments, the fastening member 46 of the first closure system may be located on the medial side panel 30 and the fastening member 46 of the second closure system may be located on the lateral side panel 28, such that both systems run in opposing directions.

In the embodiments shown in FIGS. 1-5, the guide members 40 and the fastening members 46 are attached directly to the upper panels 28 and 30. The guide members and the fastening members may be attached to the upper panels by stitching, chemical fastening, or any other suitable method. In additional embodiments, the guide members and the fastening members are directly injected to the upper.

In other embodiments shown in FIGS. 13-14 and 17-19, the guide members 40 and the fastening members 46 are positioned on a flange 48. The flange portions 48 provide a larger surface area across the foot and assist in more evenly distributing the load carried by the closure system 50 about the arch and instep area of the upper 20. The guide members and the fastening members may be attached to the flange portions 48 by any suitable method, such as stitching or chemical bonding, or may be formed integrally with the flange portions by, for example, injection from any suitable material, such as a thermoplastic material. In additional embodiments, the flange portions 48 are directly injected to the upper, and the guide members and the fastening members are mechanically fastened to the flange portions.

Figure 15:
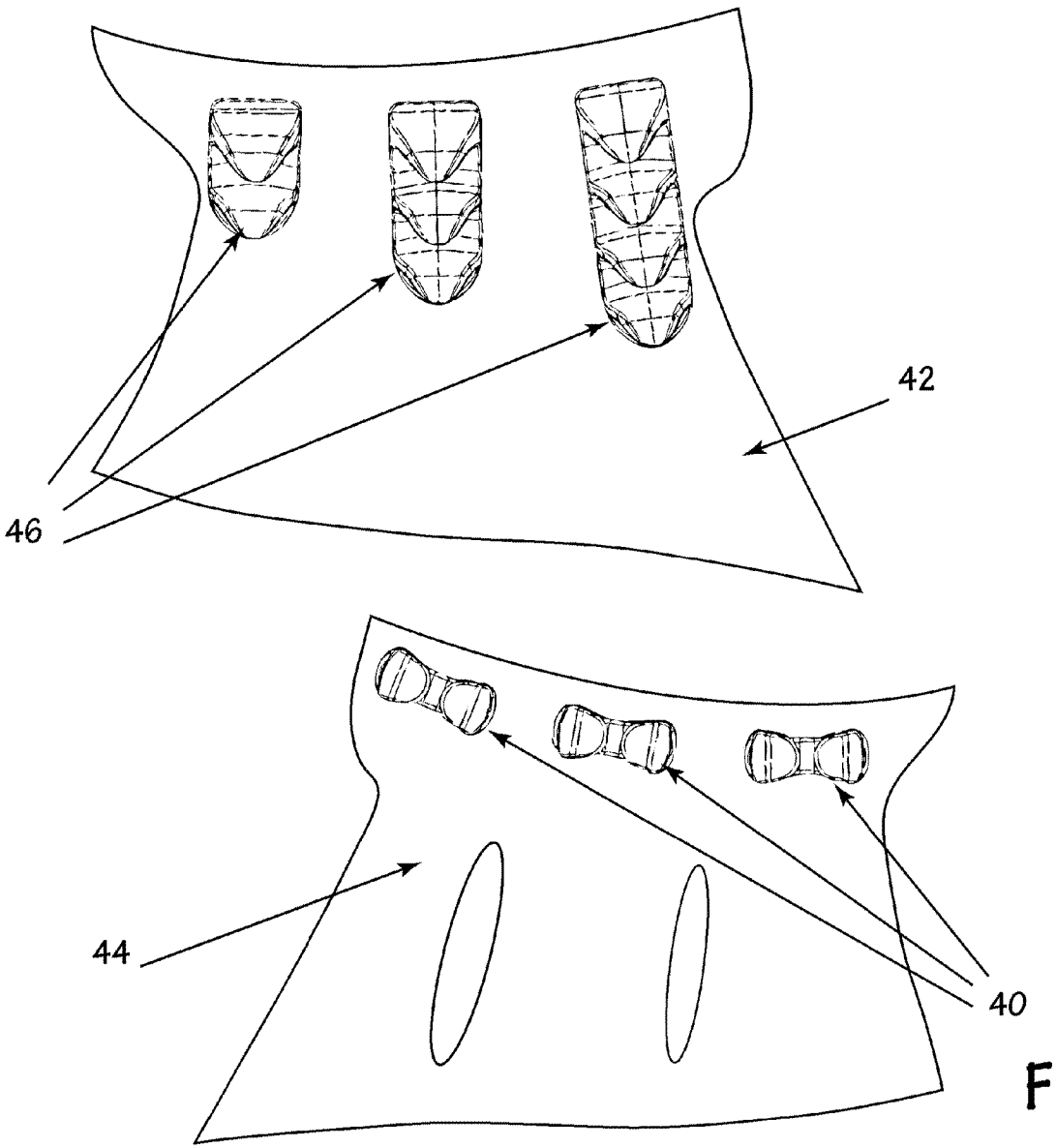
FIG. 15 is a top view of the cable guide members and anchor members of the article of footwear of FIG. 1, showing the cable guide members and anchor members attached to a common material.
Figure 16:
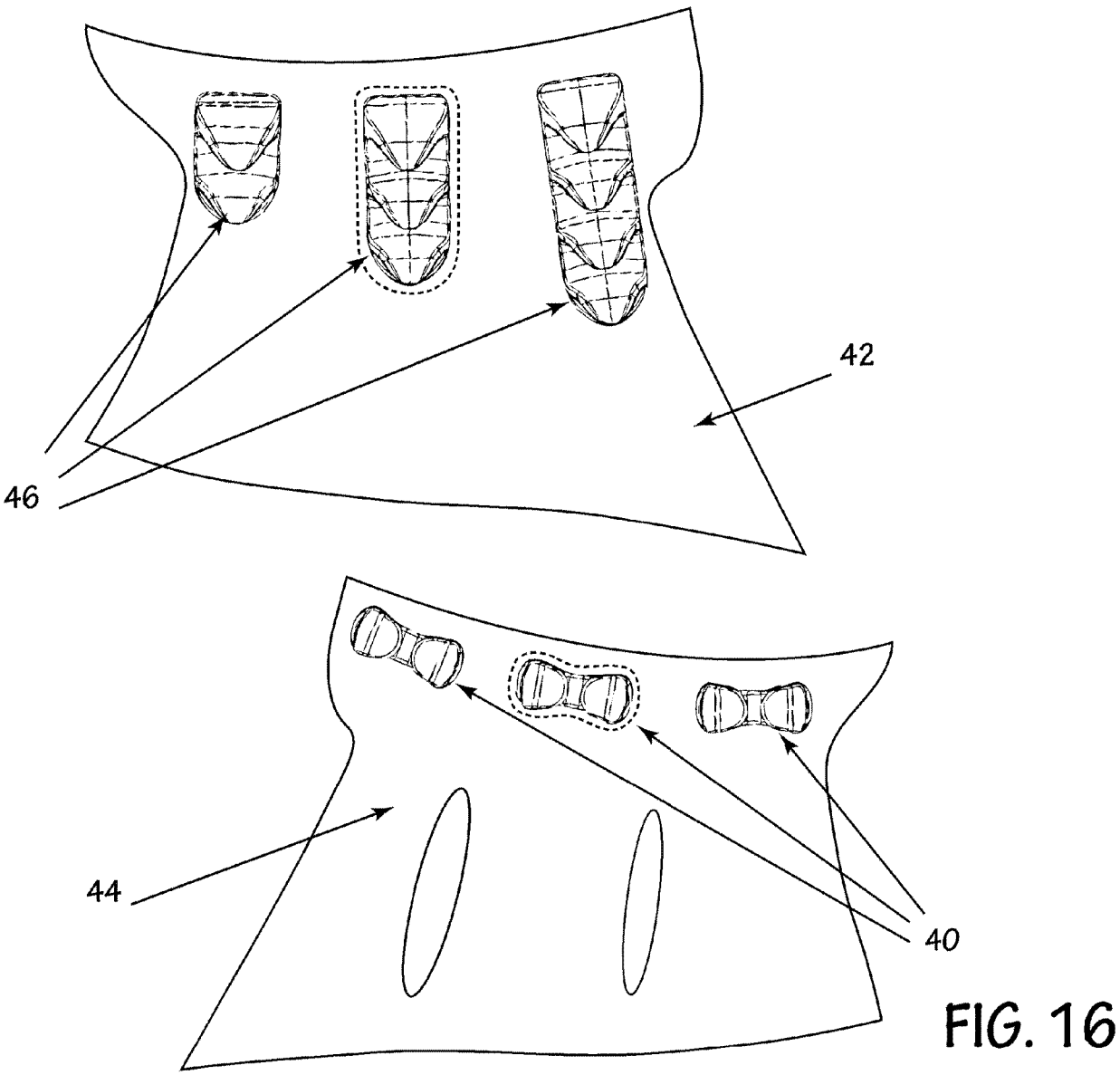
FIG. 16 is a top view of the cable guide members and anchor members of the article of footwear of FIG. 1, showing the cable guide members and anchor members stitched to a common material.

In additional embodiments, as shown in FIGS. 15-16, an underlay lateral side panel 42 and an underlay medial side panel 44 may be located under the primary lateral side panel 28 and the primary medial side panel 30 respectively in the regions immediately above the midsole 64. The guide members 40 and/or the fastening members 46 are attached to underlay panels 42 and/or 44 by any suitable method described above such that they protrude through the upper panels. The primary lateral side panel 28 and the primary medial side panel 30 may be air mesh, sandwich mesh, polyester, nylon, polyurethane, embossed or injected or any other similar or suitable material. The secondary underlay side panels 42 and 44 provide additional support to the guide members 40 and the fastening members 46, and further assist the upper 20 in providing greater adjustability options from the bottom 60 to provide proper tension across the throat 34. The underlay side panels 42 and 44 may be made with non-woven or similar suitable reinforcement material. Additional foam, padding material or the like may be located behind the guide and anchor flanges to further distribute load forces and alleviate any high pressure points of contact.

It is also contemplated that any one of the above or a combination of the above attachment methods may be incorporated into the footwear upper in accordance with the present invention.

The closure systems 50 may be independently adjustable across the arch and instep in more than one portion that communicates with the bottom and stabilizing member according to the amount of tension a wearer desires in order to achieve the best possible fit, comfort level and performance characteristics in relation to a specific gait assessment. The closure systems 50 may include differing cable materials depending on control desirability. For example, a wearer may prefer an elastic polyurethane cable in the one system and a less flexible cable in the other of two cable systems. The cable closure system 50 located on the upper 20 works in concert with the stabilizing member 100 and the bottom 60 to make for a more customized fit and to allow specific areas of the shoe 10 to perform with a greater or lesser degree of flexibility. Each closure system 50 adjusts independently from another and may provide a pronator, for example, the ability to add more or less tension in the arch area allowing the stabilizing member 100 to adjust to a better performing shape. The outsole 62 and midsole 64 will then adjust their compression response depending upon the amount of tension placed on the closure system 50. A more tensioned upper will provide a faster less flexible response and a less tensioned upper will provide a slower more flexible response.

Various configurations of the guide members 40 and the fastening members 46 may be utilized in accordance with the present invention. For example, as shown in FIGS. 15 and 16, the fastening members 46 may include two, three or four tensioning members that receive the cable assembly 90. In the configurations wherein the fastening member 46 includes more than two tensioning members, for example, as shown in FIG. 15, the tension of the closure system 50 may be adjusted by adjusting the position of the cable assembly 90 through the tensioning members. As shown in FIG. 12, a first loop 250 of the cable assembly 90 may be positioned in the first tensioning member 220 or the second tensioning member 230, and a second loop 260 of the cable assembly 90 may be positioned in the second tensioning member 230 or the third tensioning member 240.

It is noted that more than one groove portions may also be included on the guide members if desirable to allow for enhanced flexibility and adjustability. It is also contemplated that any possible combination of the guide members and the fastening members may be formed as separate parts or in a contiguous structural configuration in accordance with the present invention.

In some embodiments, the cable 90 is slideably positioned around the guide members 40 and/or fastening members 46 to provide a dynamic fit in response to movement of the foot within the footwear. The cable may be formed from any suitable material, such as, for example, a thermoplastic material, that allows for a degree of stretching as the foot expands and contracts with exercise.

The three advantageous embodiments of the present invention are described above. The first incorporates the aforementioned advantages to provide the wearer with a neutral stability shoe. The second incorporates the aforementioned advantages to provide the wearer with a lateral stability shoe. And the third embodiment incorporates the aforementioned advantages to provide the wearer with a medial stability shoe. Each configuration is designed to meet the specific demands of a wearer's unique physiology as determined by a professional gait assessment. In operation, the previously described features improve lateral stability, medial stability, and neutral stability, which are important to each gait characteristic. Further, the shoe 10 may reduce injury if properly adjusted. These advantages are achieved by the differentiation of design in the medial, lateral, and neutral portions of the shoe, and the synergistic effects between the cable closure system, the stabilizing member, and the bottom arch and posting features.

While the various features of shoe 10 work together to achieve the advantages previously described, it is recognized that individual features and sub-combinations of these features can also be used to obtain some of the aforementioned advantages without the necessity to adopt all of these features.

It should be understood that the foregoing is illustrative and not limiting, and that obvious modifications may be made by those skilled in the art without departing from the spirit of the invention. Although the invention has been described with reference to embodiments herein, those embodiments do not limit the scope of the invention.

What is claimed is:

1. An article of footwear, comprising:

an upper member comprising a top portion and a bottom portion;

a bottom member comprising a midsole and an outsole, the midsole comprising a forefoot portion, an arch portion, and a rearfoot portion, wherein:

the forefoot portion of the midsole is secured to the bottom portion of the upper member, and the bottom member has a first length; and a stabilizing member comprising a base portion, an upright heel portion, a lateral support portion, and a medial support portion member having a front and a rear wherein:

the stabilizing member is secured between the bottom portion of the upper member and the rearfoot portion of the midsole of the bottom member, the base portion of the stabilizing member having a second length that is less than the first length of the bottom member, and wherein the lateral and medial support portions are positioned in an arch portion of the stabilizing member and extend upwardly from opposing sides of the base portion, respectively, wherein the lateral and medial support portions are each reinforced with an upright support member, wherein each of the upright support members:

in the arch portion of the midsole, outwardly extends from and past an outermost surface of the midsole that is perpendicular to a plane representing a bottom surface of the outsole, and includes a bottom portion that curves beneath a bottom surface of the stabilizing member that is adjacent to the arch portion of the midsole, and wherein the upright heel portion forms a curved apex that upwardly extends from the outermost surface of the midsole that is perpendicular to the plane.

2. The article of footwear of claim 1, wherein at least one of the base portion, and the lateral support portion and the medial support portion of said stabilizing member is adapted to compress and relax as pressure is exerted on the article of footwear by a wearer's foot.

3. The article of footwear of claim 1, wherein said upright heel portion is positioned in a heel area of said stabilizing member and extends upwardly from the base portion.

4. The article of footwear of claim 1, wherein said lateral support portion and said medial support portion each has a reinforced perimeter.

5. The article of footwear of claim 1, wherein said bottom member further comprises at least one of a lateral support member and a medial support member positioned in the arch portion of said midsole, and wherein the lateral and medial support members of said bottom member interact with the lateral and medial support portions of said stabilizing member to provide support for a wearer's foot.

* * * * *